US006807748B2

(12) United States Patent
Bryan et al.

(10) Patent No.: US 6,807,748 B2
(45) Date of Patent: Oct. 26, 2004

(54) CENTRIFUGAL PELLET DRYER

(75) Inventors: David E. Bryan, Buchanan, VA (US); Carl M. Dudding, Eagle Rock, VA (US)

(73) Assignee: Gala Industries, Inc., Eagle Rock, VA (US)

( * ) Notice: Subject to any disclaimer, the term of this patent is extended or adjusted under 35 U.S.C. 154(b) by 0 days.

(21) Appl. No.: 09/861,497

(22) Filed: May 18, 2001

(65) Prior Publication Data

US 2002/0139003 A1 Oct. 3, 2002

Related U.S. Application Data

(63) Continuation-in-part of application No. PCT/US99/24432, filed on Oct. 19, 1999, now Pat. No. 6,237,244.

(51) Int. Cl.[7] ..... F26B 11/02
(52) U.S. Cl. ..... 34/108; 34/417; 34/603
(58) Field of Search ..... 34/218, 318, 319, 34/328, 417, 418, 425, 498, 499, 58, 108, 602, 603, 139, 147, 184, 371, 60, 423

(56) References Cited

U.S. PATENT DOCUMENTS

| | | | | |
|---|---|---|---|---|
| 3,458,045 A | | 7/1969 | Dudley | 210/95 |
| 4,090,309 A | | 5/1978 | Rollins | 34/58 |
| 4,218,323 A | | 8/1980 | McCracken | 210/415 |
| 4,476,019 A | | 10/1984 | Nowisch et al. | 210/232 |
| 4,565,015 A | | 1/1986 | Hundley, III | 34/182 |
| 4,570,359 A | | 2/1986 | Rudolph | 34/58 |
| 4,833,793 A | * | 5/1989 | White | 34/22 |
| 4,896,435 A | | 1/1990 | Spangler, Jr. | 34/58 |
| 5,074,057 A | * | 12/1991 | Kanai | 34/179 |
| 5,187,880 A | | 2/1993 | Rudolph | 34/8 |
| 5,197,205 A | | 3/1993 | Spada et al. | 34/182 |
| 5,265,347 A | | 11/1993 | Woodson et al. | 34/58 |
| 5,333,396 A | * | 8/1994 | Kanai | 34/166 |
| 5,505,537 A | | 4/1996 | Previero | 366/97 |
| 5,611,150 A | | 3/1997 | Yore, Jr. | 34/58 |
| 5,638,606 A | | 6/1997 | Bryan et al. | 34/59 |
| 5,987,769 A | | 11/1999 | Ackerman et al. | 34/58 |
| 6,237,244 B1 | * | 5/2001 | Bryan et al. | 34/59 |
| 6,430,842 B1 | * | 8/2002 | Hauch | 34/601 |

FOREIGN PATENT DOCUMENTS

| | | |
|---|---|---|
| DE | 31 20 792 | 12/1982 |
| DE | 43 38 030 | 11/1994 |
| FR | 330.215 | 3/2003 |
| WO | 97/41290 | 11/1997 |

OTHER PUBLICATIONS

Carter Day International brochure, Micro 2001 Dryer, Spin-away Dryers, M2/Dryer 6/97.

* cited by examiner

*Primary Examiner*—Kenneth Rinehart
(74) *Attorney, Agent, or Firm*—Jacobson Holman PLLC

(57) ABSTRACT

A centrifugal dryer (10) for removing surface moisture from pellets of resin material having a diameter generally ranging between approximately 0.015 to approximately 0.25 inches received from an underwater pelletizer. In one embodiment of the present invention, the dryer is constructed with smaller dimensions enabling it to effectively operate at low volume rates and be easily assembled and disassembled to facilitate cleaning and replacement or interchange of components with its overall size enabling it to be effectively used in small applications. In other embodiments of the present invention, the dryer is constructed with larger dimensions enabling it to effectively operate at high volume rates for use in commercial applications.

54 Claims, 18 Drawing Sheets

CENTRIFUGAL PELLET DRYER

This is a Continuation-In-part Application of PCT International Application No. PCT/US99/24432, filed Oct. 19, 1999, which claims the priority of U.S. Application No. Ser. 09/174,600, filed Oct. 19, 1998, now U.S. Pat. No. 6,237,244, issued May 29, 2001.

BACKGROUND OF THE INVENTION

1. Field of the Invention

The present invention generally relates to a centrifugal dryer for removing surface moisture from pellets of resin material having a diameter generally ranging between approximately 0.015 to approximately 0.25 inches received from an underwater pelletizer. In one embodiment of the present invention, the dryer is constructed with smaller dimensions enabling it to effectively operate at low volume rates and be easily assembled and disassembled to facilitate cleaning and replacement or interchange of components with its overall size enabling it to be effectively used in small applications. In other embodiments of the present invention, the dryer is constructed with larger dimensions enabling it to effectively operate at high volume rates for use in commercial applications.

2. Description of the Prior Art

Centrifugal pellet dryers are well known and have been successfully used for many years to separate water from a water and pellet slurry and remove surface moisture from the pellets in order to provide relatively dry surfaces on the pellets for subsequent use. The following U.S. patents, owned by the assignee of this application, relate to centrifugal pellet dryers:

| | | |
|---|---|---|
| 3,458,045 | 4,896,435 | 5,265,347 |
| 4,218,323 | 5,197,205 | 5,638,606 |
| 4,565,015 | | |

The following U.S. patents also relate to centrifugal pellet dryers:

| | | |
|---|---|---|
| 4,476,019 | 5,187,880 | 5,611,150 |
| 4,570,359 | 5,505,537 | |

The pellet dryers of the prior art do not have a sectional housing with upper and lower (base) sections being connected together by bolted external flanges for easy separation and access to the internal components. The prior art also fails to disclose the use of swing bolts to secure the housing sections together and does not disclose a depending extension on the upper housing below the flange thereon to engage the interior of the base section to provide a gasket free seal between the housing sections. The prior art also does not disclose a pellet dryer including a housing base section supported from a pivotal portion of the top of a water collecting tank to facilitate access to an underside of the base section and an inclined fines separation screen underlying the pivotal portion of the tank top in which a lower edge of the inclined fines separation screen discharges into a screened separation tray externally of the tank. In addition, the prior art does not disclose a centrifugal pellet dryer in which the rotor is supported from a single upper bearing and the lower end of the rotor is rotatably guided by an alignment bushing in the housing base section which is self-lubricating and cooled by the water of the water and pellet slurry thereby eliminating the need for providing a sealed bearing or other special device to protect a bottom bearing from the water.

Another feature not shown in the prior art is the use of a cylindrical screen in a centrifugal pellet dryer which telescopically engages a recessed edge of cup-shaped support members at the top and bottom ends of the screen and is supported by a pair of holding clips in the form of hooks to engage supporting pins on the upper cup-shaped support. Also, the prior art does not disclose the use of a lift device to assist in lifting and supporting major components away from the base section and to permit the supported components to be swung about a vertical axis away from alignment with the base section and tank to facilitate removal, cleaning and replacement of the dryer components. The prior art also fails to disclose a pellet dryer having an air circulating fan communicated with an upper end of the dryer for circulating air upwardly through the dryer for discharge laterally and upwardly to facilitate drying of the pellets. Further, the prior art does not disclose a structure on the underside of the pivotal portion of the water tank top to guide the fines and water toward an upper edge portion of the inclined fines screen.

SUMMARY OF THE INVENTION

The present invention is a centrifugal pellet dryer for removing surface moisture from resin pellets (approximately 0.015 to approximately 0.25 inches in diameter) and in one embodiment is specifically adapted for low volume use in laboratory applications and in other embodiments is specifically adapted for high volume use in commercial applications.

The centrifugal pellet dryer of this invention includes a sectional housing having separable sections that are quickly and easily connected together and disconnected from each other. The separable sections are preferably cylindrical top and base sections connected by mating external peripheral flanges that are bolted together by conventional bolts or swing bolts. The base section is mounted on a top wall of a water collecting or drain tank into which the water from the water and pellet slurry is drained, thereby eliminating the necessity of providing any piping system to remove the water from the dryer once separated from the pellets.

The centrifugal pellet dryer of this invention also includes a driven rotor that has a single supporting bearing at the upper end thereof with only an alignment bushing assembly at its lower end. A motor is preferably mounted atop a top plate to which the upper housing section is attached. The rotor supporting bearing is preferably mounted to the top plate and the alignment bushing assembly is preferably part of the lower or base section of the housing. This structure eliminates the necessity of providing a bottom bearing for the rotor and a sealing arrangement for the bottom bearing to preclude water from entering the bottom bearing thereby simplifying the structure. It also facilitates the easy separation and assembly of the top and base sections relative to each other.

Further, the centrifugal pellet dryer of this invention includes a lift and support device to lift the motor, rotor, top plate and upper housing section upwardly away from the lower or base section of the housing which allows the lifted components to be swung about a vertical axis away from the base section. This lifting, supporting and swinging structure may be in the form of a gas spring or a manually-actuated jacking device and enables removal of the upper section of the housing and screen to facilitate cleaning of the exposed bladed rotor as it remains connected to its driving shaft.

The centrifugal pellet dryer of this invention also preferably includes a cylindrical one-piece screen which is telescopically engaged with recessed end edges on top and bottom cup-like support structures. The screen also includes support hooks engaging the top support structure to removably support the screen within the top and base sections of the housing to facilitate assembly and disassembly of the screen in the dryer. Additionally, the tank includes a fines screen receiving water from the base section of the dryer for removing any solid material, partial pellets or fines which may be entrained in the water.

The pellet dryer of this invention also preferably includes a pivotal portion on the top of the water collecting or drain tank which supports the base section of the housing to provide access to an inclined fines screen in the tank, which screen has a lower edge extending outwardly of the tank to deposit separated material into a screened external tray.

The pellet dryer of this invention also includes a structure on the underside of the pivotal portion of the top of the water receiving tank to direct the water and fines toward an upper edge of the inclined fines screen.

The pellet dryer of the present invention also preferably includes a fan above the upper end of the housing and communicated with the interior thereof for circulating air upwardly through the housing and for discharge of the air laterally in relation to the housing.

Accordingly, it is an object of the present invention to provide a centrifugal pellet dryer for removing surface moisture from pelletized product which includes a sectional housing in which multiple sections are connected by external flanges that are bolted together to enable quick and easy assembly and disassembly of the housing.

Another object of the present invention is to provide a pellet dryer in which the rotor is rigid with a shaft supported by a single upper bearing and having an alignment bushing assembly guiding rotation of the lower end of the rotor thereby eliminating the need for a sealing device or special waterproof design to protect a bottom bearing from water within the dryer.

A further object of one form of this invention is to provide a centrifugal pellet dryer for laboratory applications in which the dryer is capable of operation at very low volume rates and is constructed of a relatively small overall size and of separable and replaceable components rendering it easily cleanable, repairable and otherwise well suited for laboratory or small applications.

An additional object of this invention is to provide a pellet dryer for commercial applications in other forms of the invention in which the dryer is capable of operation at very high volume rates and is constructed of a relatively larger size.

A still further object of the invention is to provide a lift for supporting and lifting the motor, the rotor and the upper housing section away from the housing base section when the dryer is being disassembled for repair and cleaning.

Still another object of the present invention is to provide a pellet dryer including a one-piece cylindrical screen having upper and lower edges telescopically engaged with recessed edges of top and bottom cup-like supports in the housing and support hooks engaging with support pins on the top support.

Yet another object of the present invention is to provide a centrifugal pellet dryer in which a base section of the housing is mounted directly on a top wall of the water drain tank so that water removed from the water and pellet slurry in the dryer can pass directly from the base section of the dryer housing into the water drain tank thereby eliminating the necessity of providing a piping system to drain water from the dryer.

It is a still further object of this invention to provide a pellet dryer in accordance with the preceding object in which the underside of the pivotal portion of the water drain tank includes a structure to direct water and fines toward the upper end portion of the screen.

An additional object of the invention is to provide a centrifugal pellet dryer in accordance with the preceding objects in which a fan is provided at the upper end of the housing for circulating air upwardly through the housing for discharge laterally of the dryer adjacent the upper end thereof.

A final object to be set forth herein is to provide a pellet dryer which will conform to conventional forms of manufacture, be of simple construction and easy to use so as to provide a dryer that will be economically feasible, long lasting and relatively trouble free in operation.

These together with other objects and advantages which will become subsequently apparent reside in the details of construction and operation as more fully hereinafter described and claimed, reference being had to the accompanying drawings forming apart hereof, wherein like numerals refer to like parts throughout.

DESCRIPTION OF THE PREFERRED EMBODIMENTS

Figure 1:
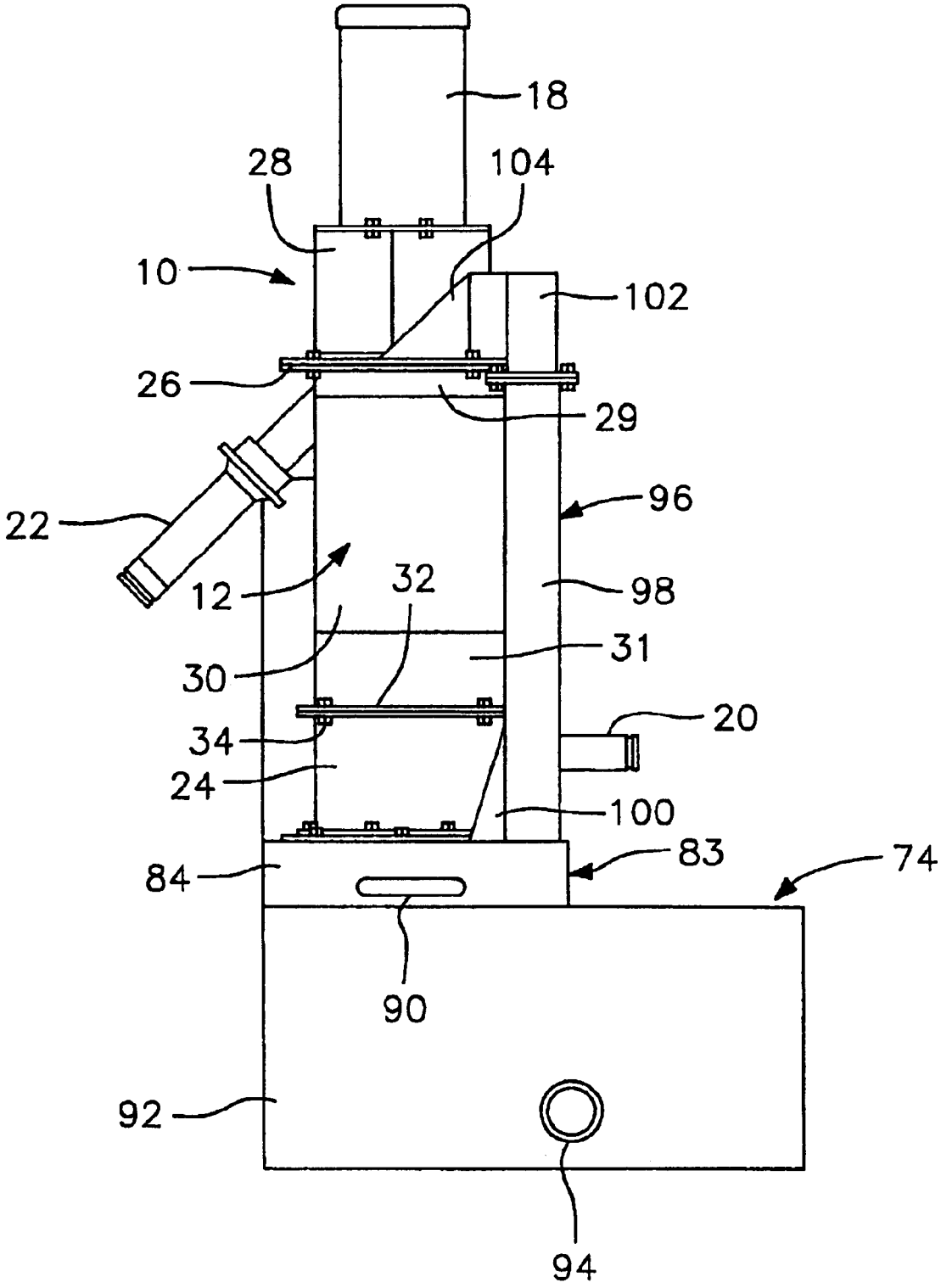
FIG. 1 is a side elevational view of one embodiment of the centrifugal pellet dryer of the present invention illustrating the relationship of the motor, housing, drain tank, inlet and outlet and a lift device for an upper section of the housing, motor, rotor and screen.

Although only preferred embodiments of the invention are explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Referring now specifically to FIGS. 1–8 of the drawings, one embodiment of the centrifugal pellet dryer of the present invention is disclosed and generally designated by reference numeral 10 and includes a vertically disposed generally cylindrical housing generally designated by the numeral 12 having a vertical rotor 14 rotatably mounted therein and which is enclosed by a screen 16. The rotor 14 is driven by a motor 18 preferably mounted atop the upper end of the dryer. The lower end of the dryer includes a slurry inlet 20 and the upper end of the dryer includes a dried pellet outlet 22. These components generally are found in existing centrifugal pellet dryers. However, certain of the components of the present invention include unique structural features and associations not known in currently available centrifugal pellet dryers.

The housing 12 includes sections preferably including a base or lower section 24 and an elongated upper section 30 which is connected to a top plate 26. The upper section 30 can include reinforcing collars 29 and 31 at the upper and lower ends. The sections 24 and 30 and top plate 26 can be interconnected by circular end flanges 32 secured together by bolts 34. A coupling guard 28 is attached above top plate 26 as by bolts or the like. The housing sections 24 and 30 and top plate 26 are preferably constructed of a substantially rigid material, such as metal or plastic, that is sufficiently strong to support the structure of the dryer, is relatively inexpensive and can be constructed in relatively small diameters and heights.

Figure 6:
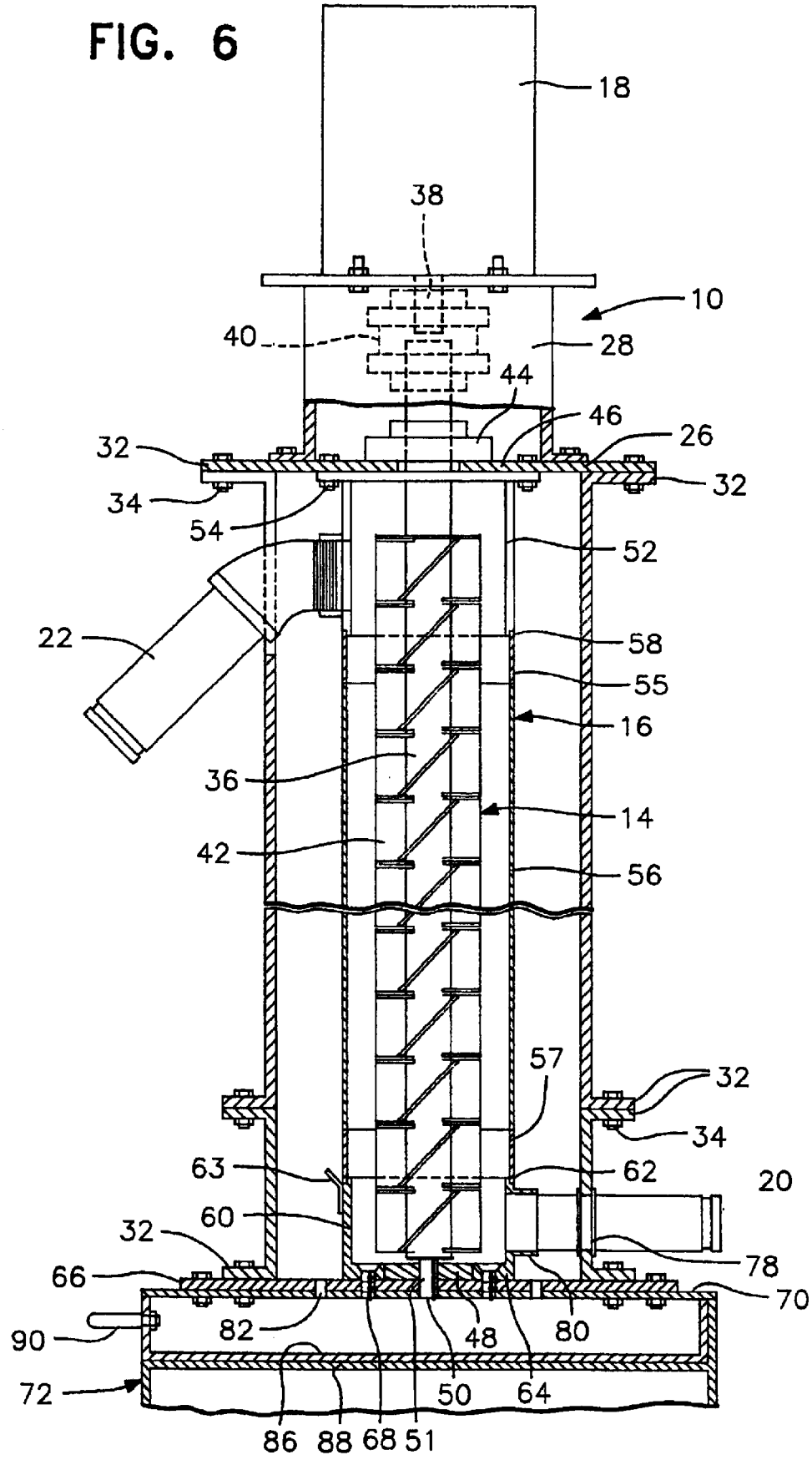
FIG. 6 is a vertical partial sectional view, on an enlarged scale, of the dryer of the present invention illustrating the association of the components of the dryer.

The rotor 14 includes a central shaft 36, preferably square, positioned centrally in the vertical housing 12 and is drivingly engaged with a motor output shaft 38 by a drive coupling 40 (see FIG. 6). The upper end of the dryer rotor 14 is provided with a support bearing 44 enclosed within the motor coupling guard 28 and a motor support enclosed by the guard 28 which is supported from the top plate 26 at the upper end of the housing as indicated at reference numeral 46. The support bearing 44 supports the rotor 14 from its upper end and maintains its support in order that the lower end of the rotor shaft 36 can be guided by a bushing 48 mounted in the base section 24 of housing 12. The lower end of the shaft 36 is provided with an axially extending shaft 50 of reduced cross-sectional area and preferably of cylindrical configuration for rotational guided movement in cylindrical opening 51 in alignment bushing 48.

The upper section 30 of the housing 12 includes a downwardly extending cylindrical member 52 secured to the top plate 26 by fastening bolts 54. The screen 16 is a cylindrical member 56 of screen or perforated material which has an upper end in the form of a solid wall 55. The wall 55 engages with a downwardly facing recess 58 in the lower edge of the cylindrical member 52 with the upper end edge of the wall 55 on screen element 56 telescoping over the recess 58 as illustrated in FIG. 6. Likewise, the lower end of the screen element 56 is supported by the top rim 61 of the upwardly facing cylindrical support 60. The top rim 61 includes a recessed upper edge 62 which telescopically receives the lower end of peripheral wall 57 of the screen element 56.

Figure 5:
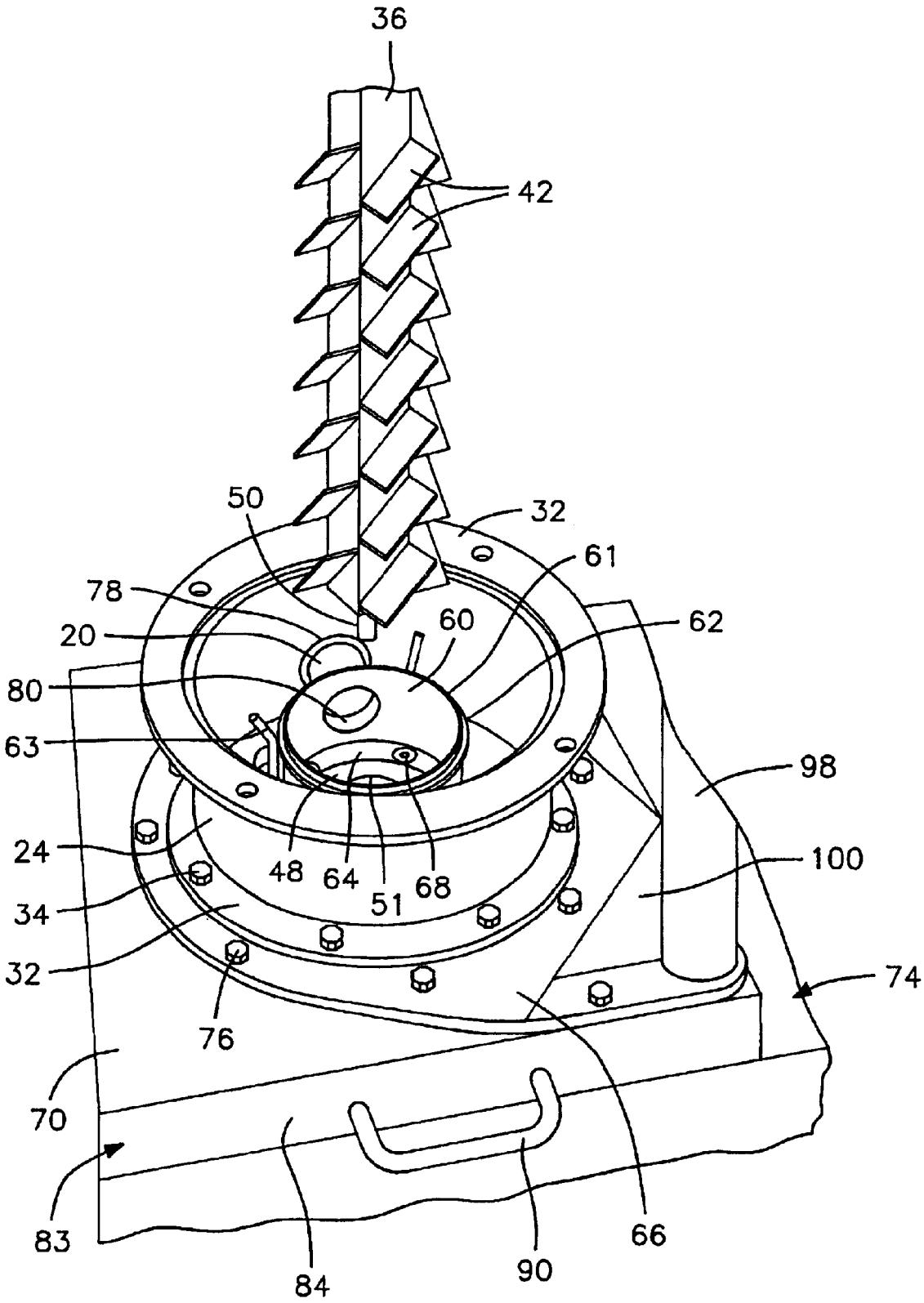
FIG. 5 is a fragmental perspective view of the base section of the housing of the present invention and the components of the lower end portions of the rotor and screen associated therewith.

The cylindrical member 60 also preferably includes a plurality of upwardly and outwardly angled rods 63 on the exterior thereof as shown in FIGS. 5 and 6 to guide the lower end of the screen 16 onto the recess 62 formed on the outer edge of the upper end of cylindrical member 60. The angled rods 63 thus facilitate assembly of the screen element 56 onto cylindrical member 60 in relation to the housing and rotor. The lower cylindrical member 60 includes a bottom wall 64 that is secured to a plate 66 by fastening devices 68.

The plate 66 is secured to the top wall 70 of a debris separating drawer assembly generally designated by reference numeral 72 positioned on top of a water drain tank generally designated by reference numeral 74 with fastening bolts 76 securing the plate 66 in position. It will be observed that alignment bushing 48 is preferably disk shaped and can be replaced if and when the opening 51 becomes worn. Bushing 48 is positioned in the center of bottom wall 64 so that extending shaft 50 and, therefore, rotor shaft 36 are both positioned substantially along the central vertical axis of the dryer 10 within screen 16 and housing 12.

The base section 24 of the housing 12 includes the inlet 20 which extends through a fitting 78 in the peripheral wall of the base section 24. The slurry inlet 20 extends into and is connected to a fitting 80 in the cylindrical member 60 thus communicating the slurry inlet 20 with the interior of the cylindrical member 60 and thus screen 16. This enables the rotor 14 to rotate and lift the slurry and pellets upwardly and directing them outwardly toward the screen element 56 so that water entrained with the pellets will be discharged through the screen. The water discharged through the screen and outwardly of the lower cylindrical member 60 can pass through the plate 66 and the top wall 70 through apertures 82 thus enabling the water to drain into the debris separating drawer assembly 72.

The separating drawer assembly 72 includes a slidable drawer 83 having a peripheral vertical wall 84 and a screen or perforated bottom 86. The drawer 83 is slidably supported on ledges 88 at the bottom of the drawer assembly 72. A handle 90 is provided at the front of the drawer 83 to move the drawer outwardly to remove any solids or pellets which may have been discharged through the apertures 82 so that only water is discharged into a water drain tank 92. The tank 92 is also provided with an opening 94 to facilitate discharge of water separated from the pellets.

As the pellets are moved upwardly in screen 16 by rotor 14 they are dried by virtue of the forces of gravity and the centrifugal force of the pellets being discharged toward the screen in a manner well known in the pellet drying art. Once the dried pellets reach the upper end of the rotor, they are discharged centrifugally into the dry pellet outlet 22 in communication with cylindrical member 52 and then into a suitable container.

Figure 2:
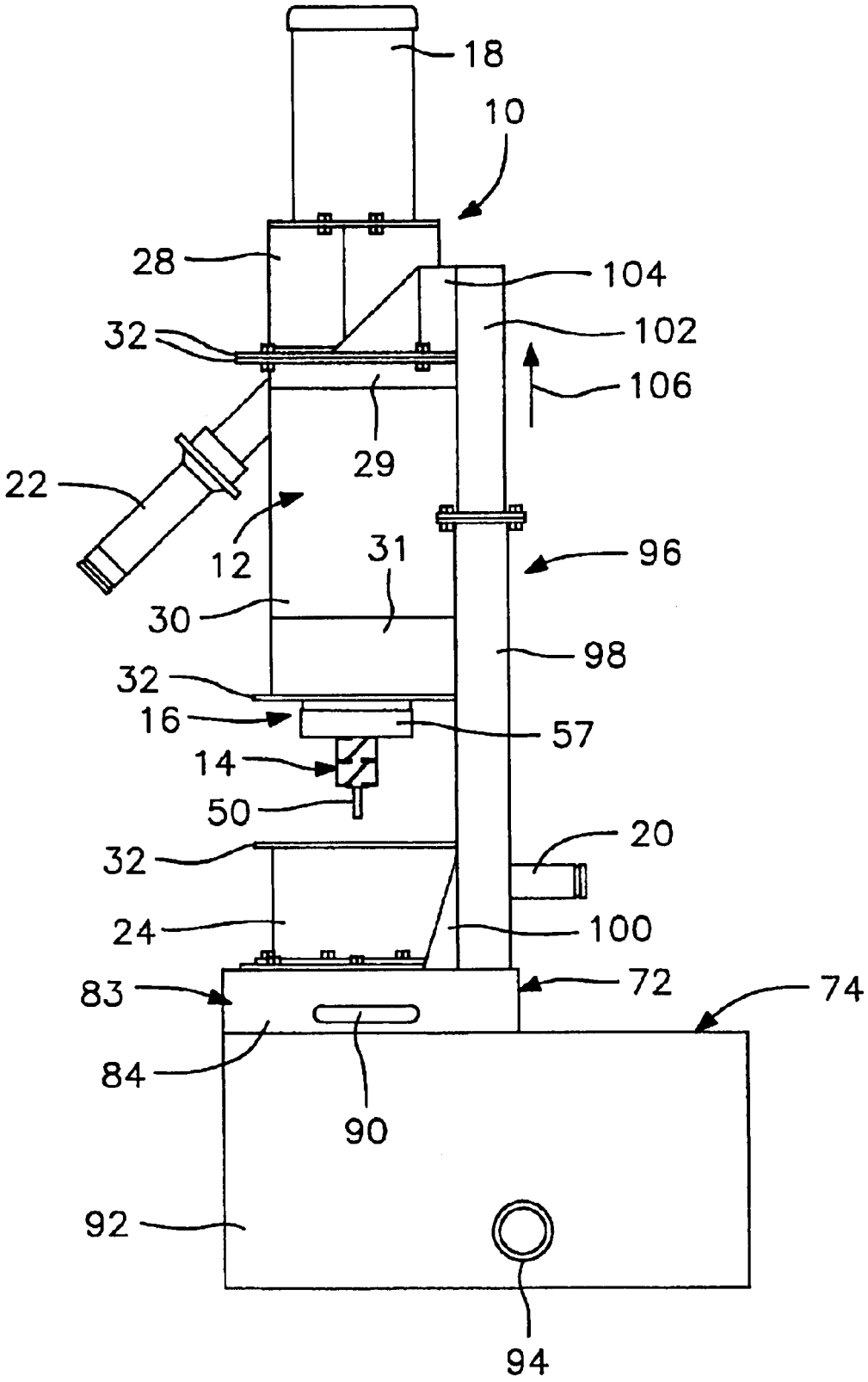
FIG. 2 is a side elevational view similar to FIG. 1 but illustrating the base section of the housing detached from the remainder of the housing which has been lifted vertically away by the lift device.

The upper section 30, the top plate 26, the coupling guard 28 and the motor 18 and its support along with the rotor 14 and screen 16 are all supported by a lifting device, preferably a gas spring lift device 96 in this embodiment. The gas spring lift device 96 includes a stationary outer tube 98 rigidly affixed to plate 66 on top wall 70 by bracket structure 100 and fastening bolts as shown in FIG. 5. A swivelled vertically movable telescopic upper tube 102 is attached to the motor support and upper section 26 of the housing 12 by bracket structure 104. This gas spring 96 will assist in lifting and will support the upper section 30 of the housing 12 including the rotor, screen, motor support and motor when the bolts 34 interconnecting the flanges 32 between the upper section 30 and base section 24 of the housing are removed. The vertical movement of the upper tube 102 is illustrated in FIG. 2 as indicated by the arrow 106.

Figure 3:
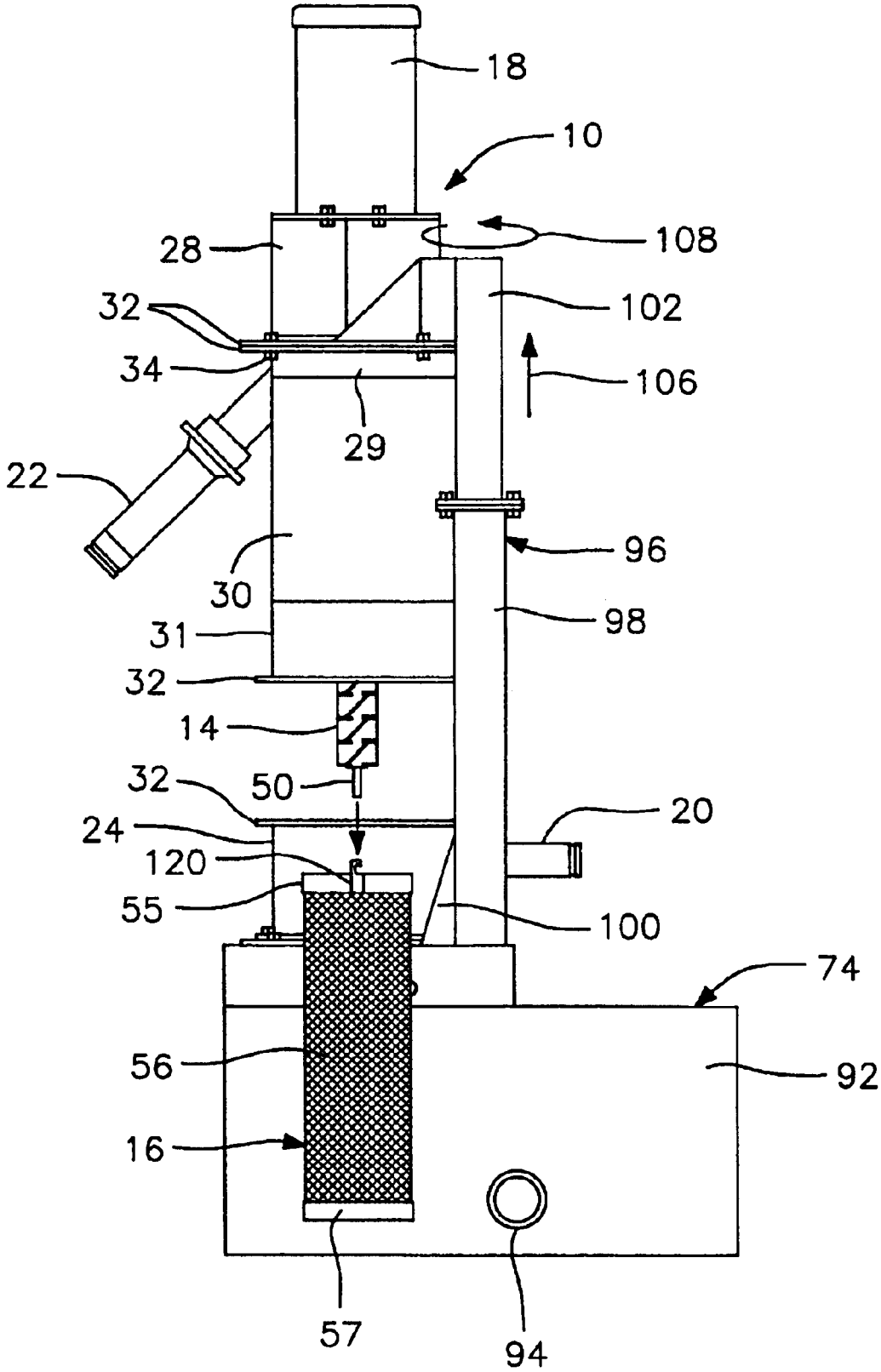
FIG. 3 is a side elevational view similar to FIG. 2 but illustrating the swiveling movement of the lifted dryer components of the dryer and the dryer screen being removed from enclosing relation to the rotor.
Figure 4:
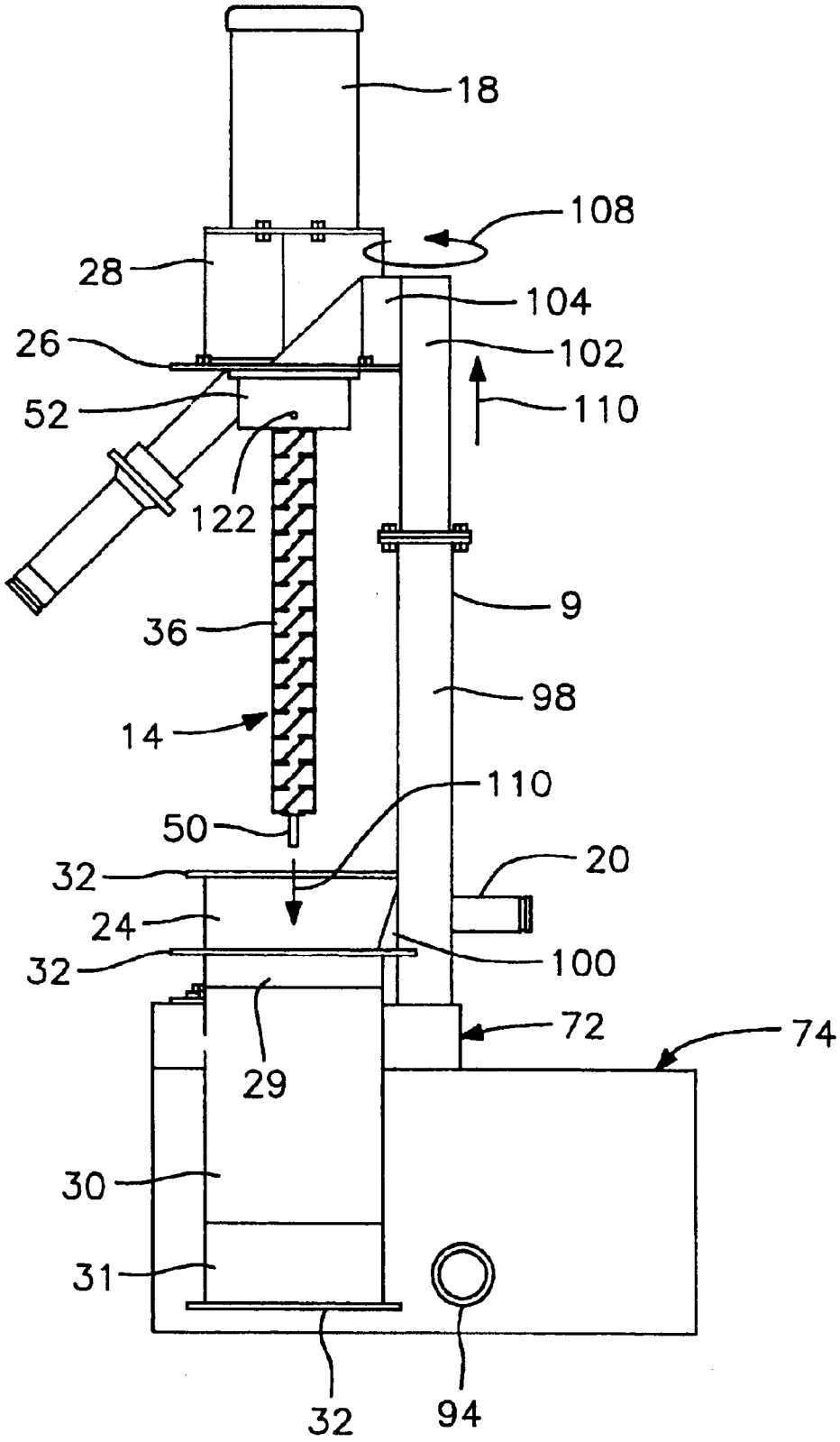
FIG. 4 is a side elevational view similar to FIG. 3 and illustrating the upper section of the housing being removed to completely expose the rotor.

The upper tube 102 of the gas spring 96 is also capable of swivel movement which enables the lifted components to rotate about the vertical axis of the gas spring as indicated by arrow 108 in FIG. 3. Thus, the upper section 30 of the housing and those components above the upper section along with the rotor 14 and screen 16 can then rotate out of alignment with the base section 24 and tank 92. Once the upper section 30 has been rotated out of alignment with the base section 24, the screen 16 can be dropped downwardly and removed as illustrated in FIG. 3. Also, this structure enables the upper section 30 of the housing 12 to be separated from the top plate 26 and dropped downwardly as indicated by arrow 110 in FIG. 4. This separation enables removal of the upper section of the housing thereby providing easy access to the rotor 14 which remains attached to the shaft coupling 40 as illustrated in FIG. 4. The shaft 36 and inclined blades 40 can then be easily cleaned while being supported above the base section, or the axial extension 50 may be lowered into the guide bushing 48 to stabilize the lower end of the rotor 14 while being cleaned.

FIGS. 3 and 4 illustrate an additional support for the screen which is preferred in most installations. The additional support is in the form of two (or more) upwardly extending hooks 120 rigidly connected to the upper end wall 55 of the screen member 56. The hooks 120 are preferably oriented diametrically on the outer surface of wall 55 and open in opposite peripheral directions to engage with outwardly projecting pins 122 on top support structure 52. The hooks 120 and screen member 56 must be rotated counterclockwise a partial revolution to release the screen to be moved downwardly for removal.

Figure 7:
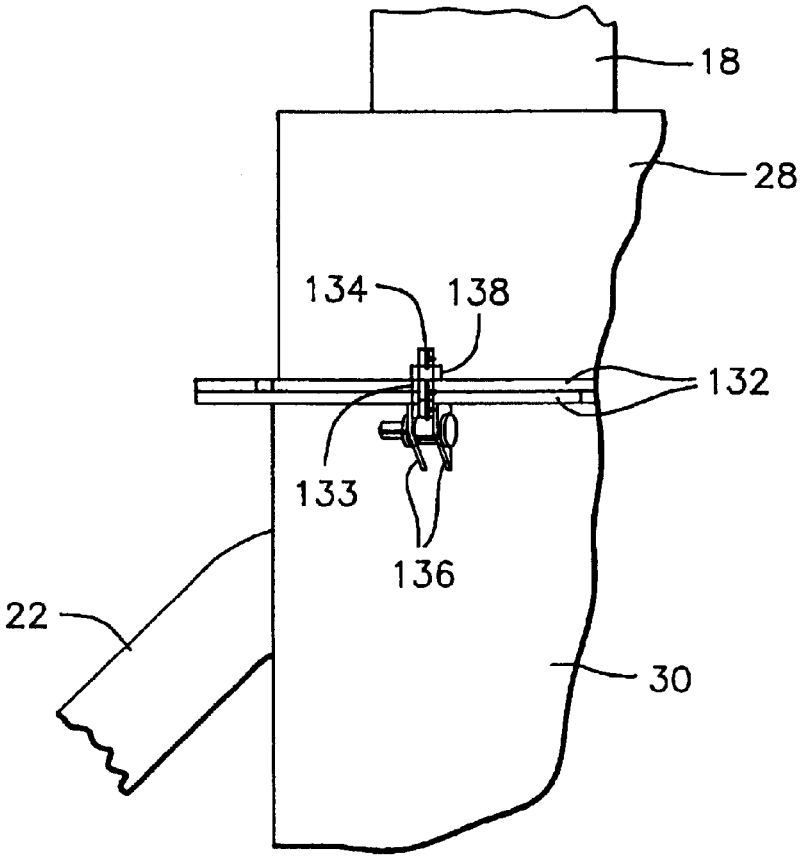
FIG. 7 is a fragmental enlarged elevational view of a portion of the housing illustrating a preferred form of bolted flange arrangement utilizing swing bolts.

FIG. 7 illustrates an additional preferred connection between housing sections in which each of the flanges 132 have a notch or slot 133 which has a swing bolt 134 extending therethrough. The lower end of swing bolt 134 is pivotally supported by support lugs 136 attached to the housing. The upper end of the bolt 134 includes a nut 138 which can be loosened sufficiently to enable pivotal movement of the bolt 134 without complete removal of the nut 138 and without separating the bolt from the housing thereby greatly facilitating the assembly and disassembly of the housing sections of the dryer. The swing bolt 134, support lugs 136 and nut 138, preferably in the form of a manually grasped handwheel, can be used in lieu of the bolt shown in FIGS. 1–6.

Figure 8:
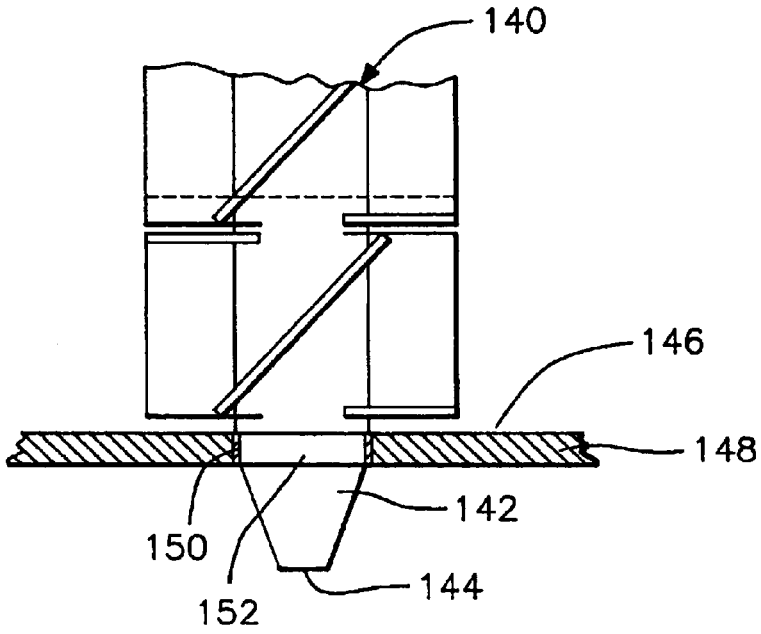
FIG. 8 is a fragmental enlarged sectional view of a preferred form of guide bushing assembly for the lower end of the rotor.
Figure 9:
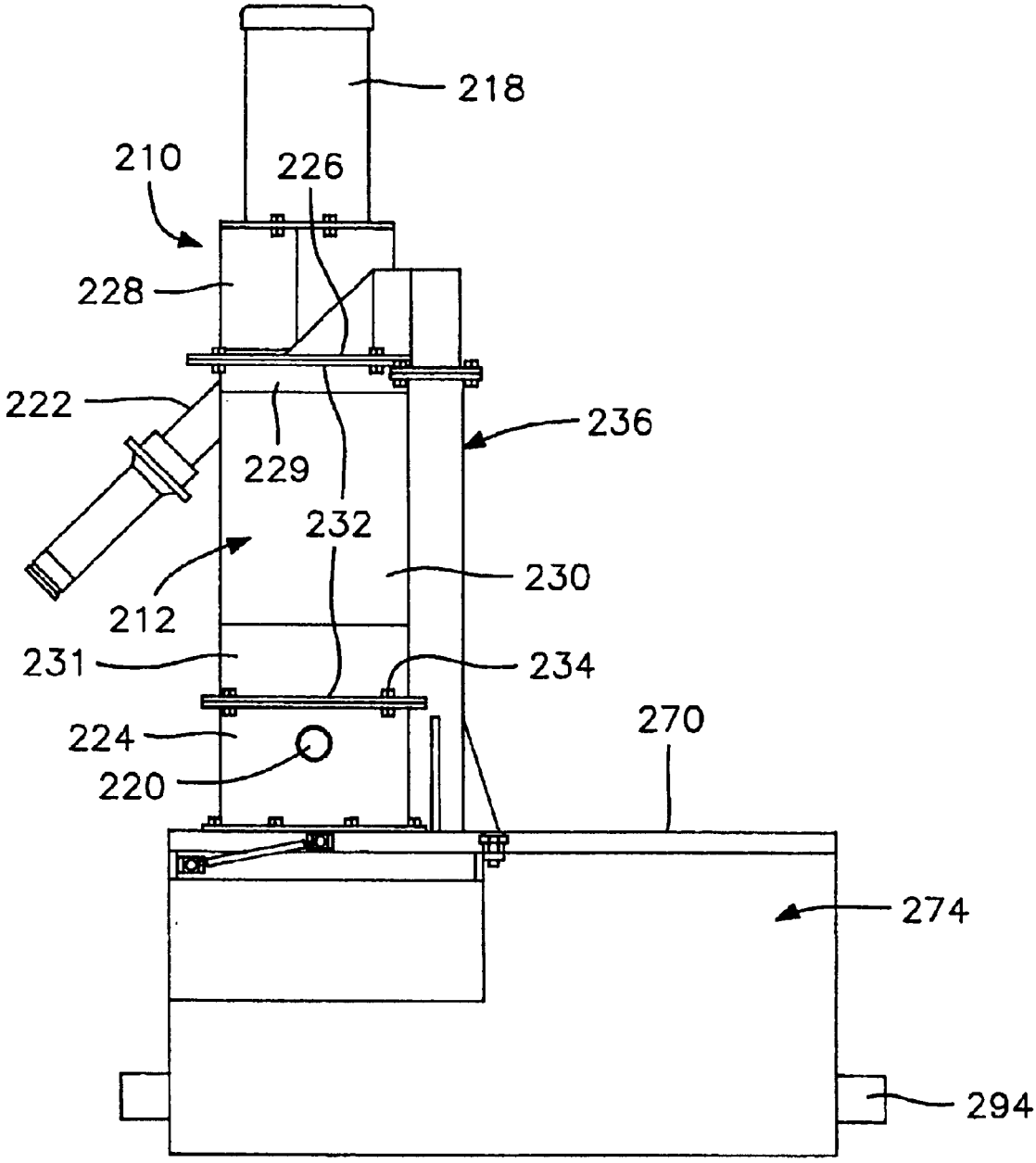
FIG. 9 is a side elevational view of another embodiment of the centrifugal pellet dryer of the present invention illustrating the relationship of the motor, housing, drain tank, slurry inlet and dried-pellet outlet.

FIG. 8 illustrates an additional preferred form of the bushing for the lower end of the rotor in which the lower end of rotor 140 is provided with a generally tapered lower end 142 with a flat lower end 144. In lieu of the bushing 48, a two-piece bushing assembly 146 is employed to guide the lower end of the rotor 140 during rotation. The bushing assembly 146 includes an outer member 148 of resin material and an inner sleeve or bushing 150 of metal. The sleeve or bushing 150 is cylindrical and rotatably engages and guides a cylindrical upper end portion 152 of the tapered lower end 142 of the rotor 140. The tapered lower end 142 assists in guiding the lower end of the rotor into the guide sleeve or bushing 150. Water passing through the bushing assembly 146 cools and lubricates the sleeve 150 and lower end of rotor 140. Like bushing 48, the bushing assembly 146 is supported in the bottom of the cup-shaped support 60 and can be replaced when necessary.

The function of the rotor 14 or 140, screen 16 and housing 12 together with the slurry inlet 20 and dried pellet outlet 22 are similar to the function of existing centrifugal pellet dryers. However, the manner in which the rotor is supported and driven and guided by a replaceable alignment bushing 48 or bushing assembly 146 and the sectional construction of the housing and the gas spring lift device cooperate to enable the components to be constructed with a reduced diameter housing, screen and reduced size rotor. The housing 12 of this embodiment of the invention can have an outside diameter in the range of 8 to 12 inches while most standard dryers have an outside diameter in the range of 30 to 40 inches. The screen 16 can have a diameter of approximately 6 inches with the outer corners of the blades 42 being spaced approximately 0.400 inch from the screen for optimum removal of water from the pellets. The blades 42 are preferably rectangular with the straight peripheral edges providing agitation of the pellets as they are lifted with the space between the blades and screen permitting some of the pellets to drop past upper blades and picked up by lower blades for more effective separation of water from the pellets. Also, the blade arrangement and configuration and their relationship to the screen reduces wear on the screen as compared to dryers which utilize a substantially continuous lifting and auguring effect that increases frictional engagement between the pellets and screen.

The components of the dryer of this embodiment are readily disconnected and the weight thereof supported by the gas spring 96 thereby facilitating the handling of the housing, screen, rotor and motor without the necessity of these components being physically lifted by an operator of the pellet dryer. The smaller diameter of the components in this form of the invention enables the dryer to be effectively used in a laboratory application, or other small operation, and enables the components to be easily disassembled and assembled, and the components easily cleaned or replaced when disassembled. The screen bottom drawer enables the water draining into the tank to be cleaned of any solid debris or pellets which may pass downwardly from the base section of the housing. The openings communicating the base section of the housing and the screened bottom drawer may be varied in size and frequency to enable gravity liquid flow downwardly from the base section without undue restriction.

FIGS. 9–16 illustrate a second embodiment of the centrifugal pellet dryer of the present invention generally designated by reference numeral 210. This second embodiment is preferably a commercial form of the dryer of the present invention, having dimensions consistent with known centrifugal pellet dryers and thus substantially larger than a laboratory pellet dryer such as shown in FIGS. 1–8.

The dryer 210 includes a vertically disposed generally cylindrical housing generally designated by the numeral 212 having a vertical rotor 214 rotatably mounted therein and which is enclosed by a screen 216 in the same manner that screen 16 encloses rotor 14 in FIG. 2. The rotor 214 is driven by a motor 218 preferably mounted atop the upper end of the dryer. The lower end of the dryer includes a slurry inlet 220 and the upper end of the dryer includes a dried pellet outlet 222. A water drain tank generally designated by the reference numeral 274 is mounted directly below the housing 212 and numeral 270 generally designates the top of tank 274.

Figure 10:
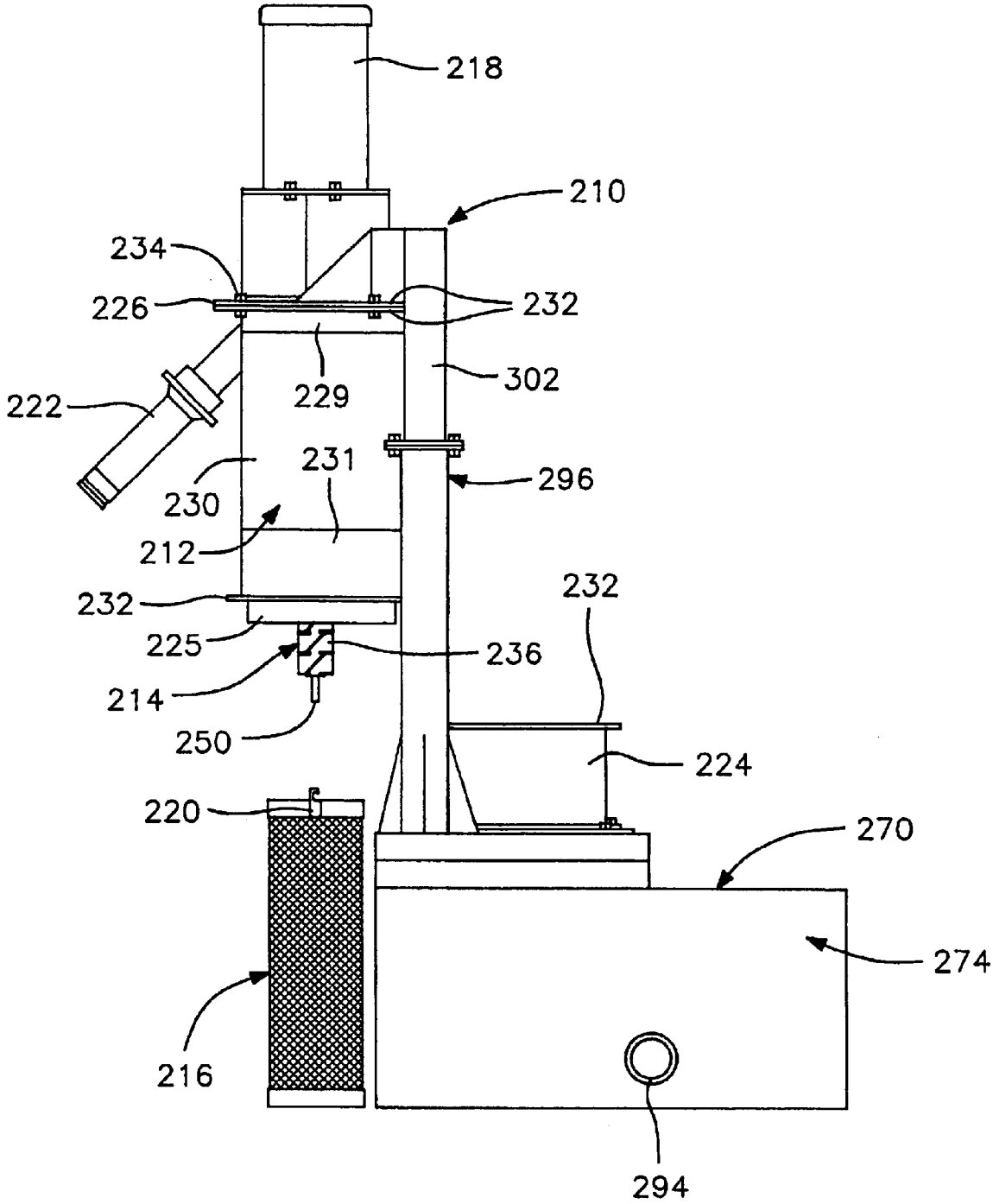
FIG. 10 is a side elevational view similar to FIG. 9 but illustrating the upper section of the housing detached from the base section of the housing and lifted vertically by the lift device and swung to a position to enable the dryer screen to be removed from inside the housing upper section and from enclosing the rotor.

The housing 212 includes two separable sections, a base or lower section 224 and an elongated upper section 230 which is connected to top plate 226. The upper section 230 can include reinforcing collars 229 and 231 at the upper and lower ends. The sections 224 and 230 and top plate 226 are preferably interconnected by circular end flanges 232 secured together by conventional or swing bolts 234. As shown in FIG. 10, the lower end of the upper section 230 of the housing 212 extends below flange 232 at the lower end thereof as indicated at 225 which is in close telescopic relation to the interior of base section 224 to provide a gasket free seal between the base section 224 and upper section 230 of housing 212. A coupling guard 228 is attached above top plate 226 as by bolts or the like. The housing sections 224 and 230 and top plate 226 are preferably constructed of a substantially rigid material, such as metal or plastic, that is sufficiently strong to support the structure of the dryer, is relatively inexpensive and can be constructed with relatively large diameters and heights.

The rotor 214 includes a central shaft 236, preferably square, positioned centrally in the vertical housing 212 and is drivingly engaged with a motor output shaft by a drive coupling similar to the shaft 38 and coupling 40 illustrated in FIG. 6. The upper end of the dryer rotor 214 is provided with a support bearing similar to bearing 44 in FIG. 6 and which is enclosed within the motor coupling guard 228. A motor support is enclosed by the guard 228 which is supported from the top plate 226 at the upper end of the housing 212. The support bearing supports the rotor 214 at its upper end and maintains its support in order that the lower end of the rotor shaft 236 can be guided by an alignment bushing 248 mounted in the base section 224 of housing 212. The lower end of the shaft 236 is provided with an axially extending shaft 250 similar to that illustrated in FIG. 6 of reduced cross-sectional area and preferably of cylindrical configuration for rotational guided movement in cylindrical opening 251 in alignment bushing 248.

The upper section 230 of the housing 212 includes a downwardly extending cylindrical cup-shaped member supporting the upper end of the screen in the manner illustrated in FIGS. 1–8. The screen has its lower end supported from an upwardly facing cup-shaped cylindrical support 260 in the base section 224 in the same manner as the embodiment shown in FIGS. 1–8.

The lower cylindrical support 260 includes a bottom wall 264 that is secured to a bottom plate 266 of the base section 224 by fastening devices 268. The bottom plate 266 is secured to a pivotal portion 269 of the top wall 270 of water drain tank 274. The plate 266 is preferably secured with fastening bolts 276 thus securing the bottom plate 266 and base section 224 to pivotal portion 269 of the top wall 270 of tank 274. Positioned directly below the pivotal portion 269 of top wall 270 at the top of tank 274 is a fines separating screen assembly generally designated by reference numeral 272. The other portion 271 of top wall 270 is also preferably openable as by hinges to allow full access into the interior of the tank 274. Alignment bushing 248 is preferably disk shaped and replaceably secured to bottom wall 264 of support 260 by screws 249. Thus, the bushing 248 can be replaced if and when the opening 251 becomes worn. Bushing 248 is positioned in the center of bottom wall 264 so that the extending shaft 250 and, therefore, rotor shaft 236 are both positioned substantially along the central vertical axis of the dryer 210 within screen 216 and housing 212.

The base section 224 of the housing 212 includes the slurry inlet 220 which extends through a fitting 278 in the peripheral wall of the base section 224. The slurry inlet 220 extends into and is connected to a fitting 280 in the cylindrical member 260 thus communicating the slurry inlet 220 with the interior of the cylindrical member 260 and the screen 216. This enables the rotor 214 to rotate and lift the slurry and pellets upwardly and directing them outwardly toward the screen element 216 so that water entrained with the pellets will be discharged outwardly through the screen. The water discharged through the screen and outwardly of the lower cylindrical member 260 can pass through the base section 224 and the top wall 270 through apertures 282, thus enabling the water to drain into the fines separating screen assembly 272.

The tank 274 is also provided with an opening 294 to facilitate discharge of water separated from the pellets. A guard 295 prevents any uncaptured pellets or fines from escaping tank 274 with the waste water through opening 294. As the pellets are moved upwardly the water is removed by virtue of the forces of gravity and the centrifugal force of the pellets being forced toward the screen in a manner well known in the pellet drying art. Once the dried pellets reach the upper end of the rotor 214, they are discharged centrifugally into the dry pellet outlet 222 in communication with the upper cylindrical section 230 and then into a suitable container.

The upper section 230, the top plate 226, the coupling guard 228 and the motor 218 and its support along with the rotor 214 and screen 216 are all movably supported by a lifting device 296. The lifting device 296 is preferably a gas spring lift device which includes a stationary outer tube 298 rigidly affixed to base plate 299 by bracket structure 300 and fastening bolts. A swivelled vertically movable telescopic upper tube 302 is attached to the motor support and upper section 226 of the housing 212 by bracket structure 304. This lift device 296 will lift and support the upper section 230 of the housing and the rotor, screen, motor support and motor when the bolts 234 interconnecting the flanges 232 of the upper section 230 and the base section 224 of the housing are removed. The vertical movement of the upper tube 302 and its swivelling movement is illustrated in FIG. 10. Alternatively, in large size dryers it may be desirable to use a positive lifting device, such as a screw jack as included in the third embodiment described hereinafter.

Figure 11:
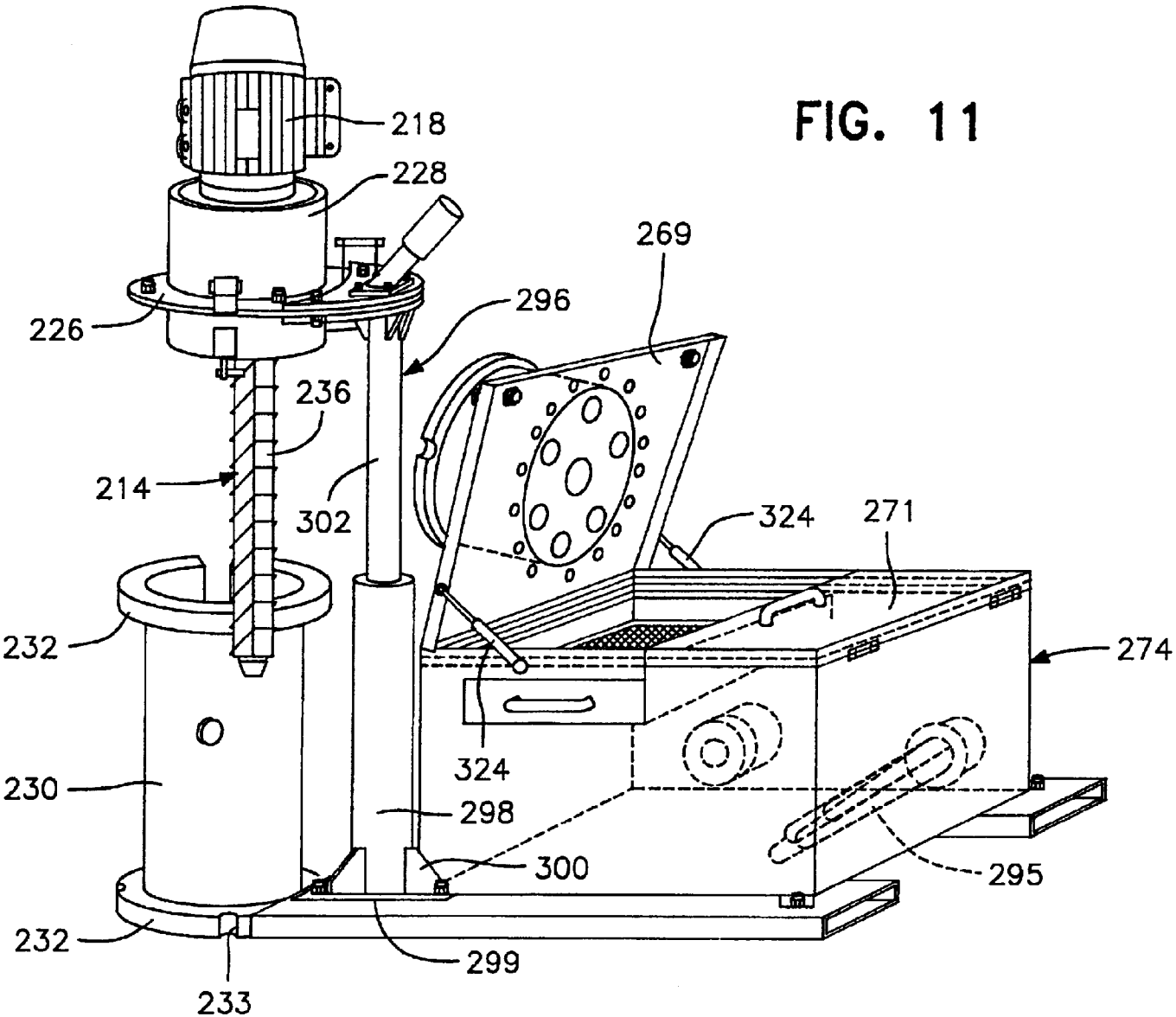
FIG. 11 is a schematic perspective view of the sections of the housing, the lift device and water drain tank of the present invention with the motor and rotor swung away from the water tank, with the upper housing section and screen removed and with a portion of the top of the water drain tank and the base section thereon pivoted to an open position.
Figure 12:
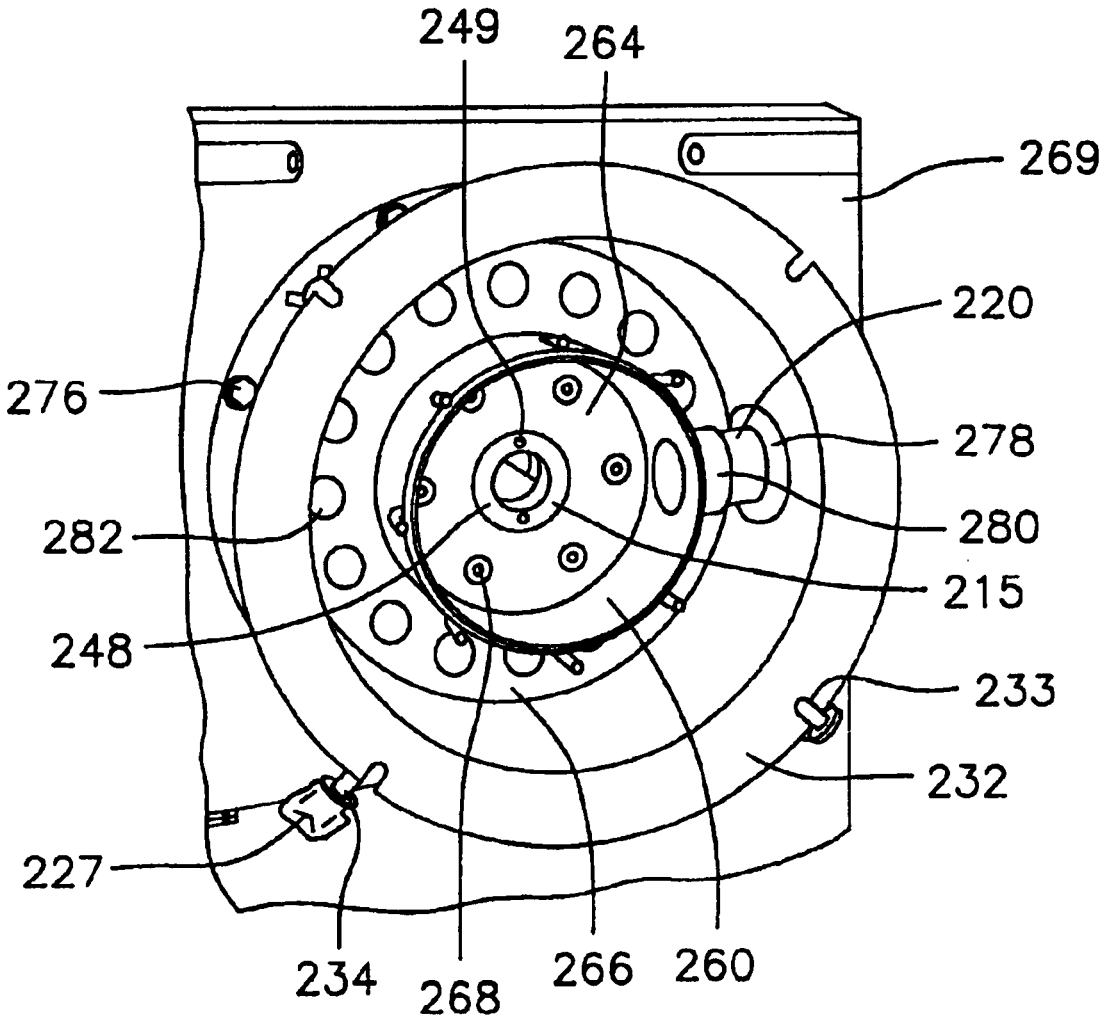
FIG. 12 is a plan view of the base section of the dryer of the present invention mounted on a pivotal portion of the water drain tank top.
Figure 13:
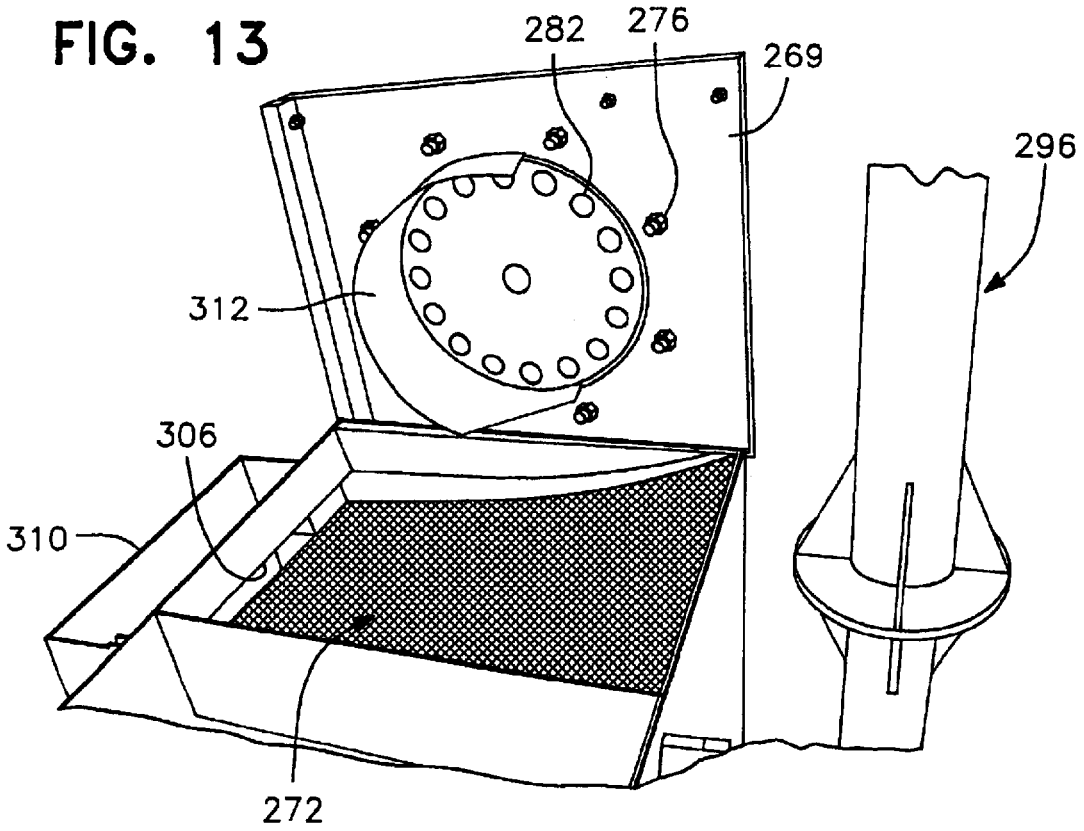
FIG. 13 is a fragmental enlarged perspective view of the underneath side of the top of the water drain tank pivoted to an open position and the inclined fines screen in the top of the water tank.
Figure 14:
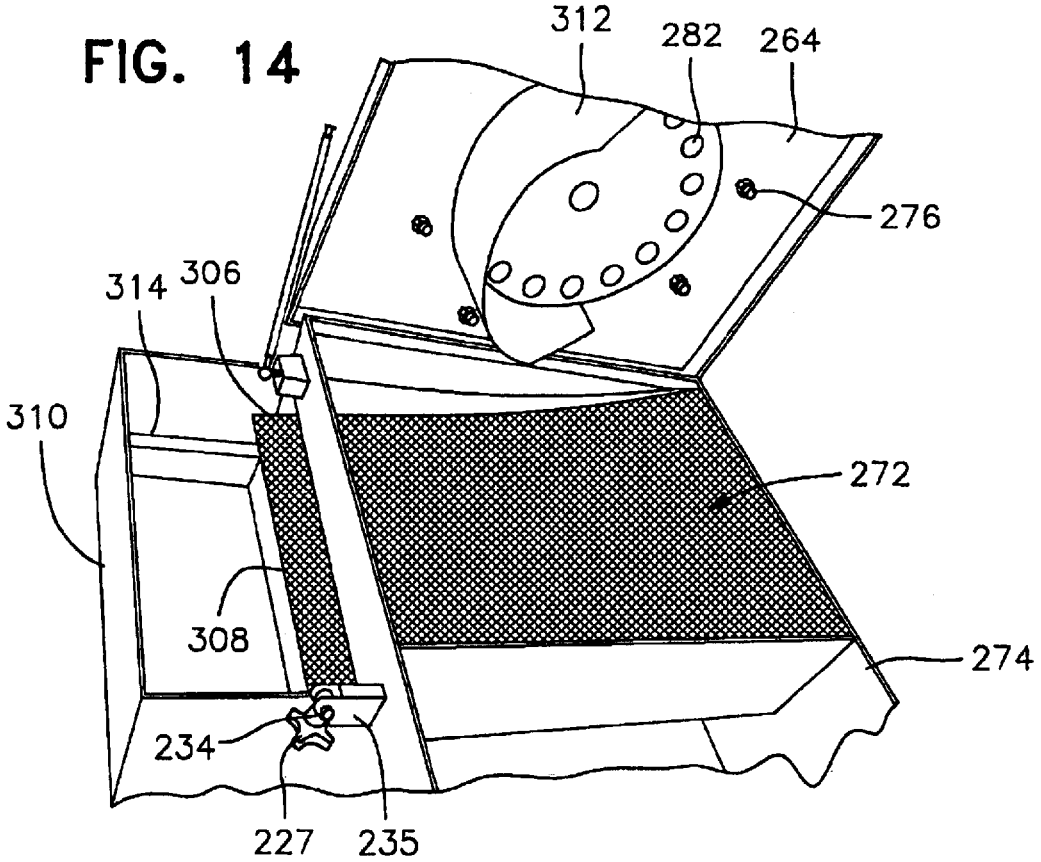
FIG. 14 is a fragmental perspective view of the fines screen and external fines screen tray on the drain tank.

The swivel movement of upper tube 302 of the lift device 296 enables the lifted components to rotate about the vertical axis of the gas spring lift device. Thus, the upper section 230 of the housing and those components above the upper section along with the rotor 214 and screen 216 can then rotate out of alignment with the base section 224. Once the upper section 230 has been rotated out of alignment with the base section 224, the screen 216 can be disengaged at the top, dropped downwardly and removed. Also, this structure enables the upper section 230 of the housing 212 to be separated from the top plate 226 and dropped downwardly as illustrated in FIG. 11. This separation enables removal of the upper section of the housing thereby providing easy access to the rotor 214 which remains attached to the shaft coupling. Shaft 236 including inclined blades 240 can then be easily cleaned while being supported away from the base section.

An additional support for the screen 216 is preferred in most installations. The additional support is in the form of two (or more) upwardly extending hooks 220 rigidly connected to the upper end wall of the screen in the manner described in connection with FIGS. 1–8. The hooks are preferably oriented diametrically on opposite side of the outer surface of the cylindrical wall at the upper end of the screen 216 and open in opposite peripheral directions to engage with outwardly projecting pins on top support structure. The hooks and screen must be rotated counterclockwise a partial revolution to release the screen before it can be moved downwardly for removal.

The connection between housing sections includes outwardly extending mating flanges 232 on the bottom of the upper section 230 and the top of the base section 224 and provided with notches or slots 233 each of which has a swing bolt 234 extending therethrough. The lower end of swing bolt 234 is pivotally supported by support lugs 235 attached to the housing. The upper end of the bolt 234 includes a nut 227 in the form of a handwheel which can be loosened sufficiently to enable pivotal movement of the bolt 234 without complete removal of the nut 227 and without separating the bolt from the housing thereby greatly facilitating the assembly and disassembly of the housing sections of the dryer.

As illustrated in FIGS. 13–16, the inclined screen 272 is positioned below the pivotal portion 269 of the tank top 270 and extends from a high side adjacent one wall of the tank 274 slanting downwardly toward the opposite side. At the opposite side the screen 272 extends through a slot 306 with the terminal edge 308 of the screen being positioned vertically above a generally rectangular trap 310 mounted on the exterior of the tank 274. The under surface of the pivotal portion 269 of the tank top includes a downwardly extending arcuate baffle 312 which assures that the fines and water coming through the holes 282 will engage the screen 272 adjacent its upper end so that the fines and water will tend to move along the surface of the screen. The water thus passes through the screen 272 into the tank 274, and the fines are discharged from the edge 308 of the screen into the trap 310. The trap 310 includes supporting ledges 314 spaced upwardly from the bottom surface thereof for supporting a lift tray 316 which includes end handles 318 with the tray 316 including a screen section 320 forming the bottom of the tray 316. Thus, any water that may drop into the trap 310 along with the fines will drop to the bottom of the trap 310 and discharge through a drain opening 322 into a receptacle, drain piping or back into the collecting or drain tank 274. As shown in FIG. 11, a drawer type fines screen as shown in FIGS. 1–8 can be used in this form of the invention.

Figure 15:
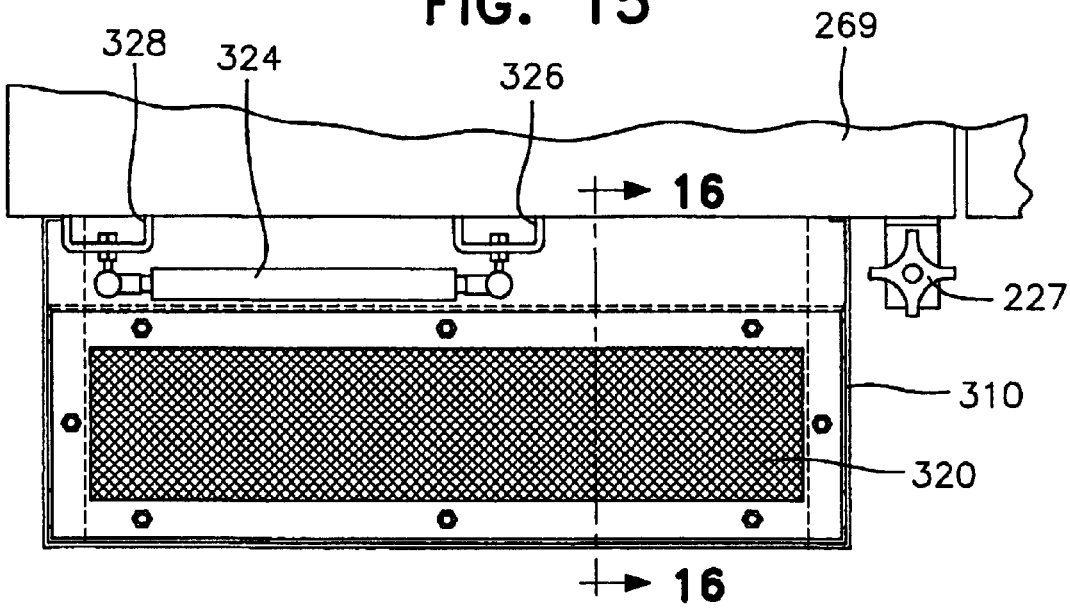
FIG. 15 is a detailed top plan view of the external fines screen tray on the water drain tank.
Figure 16:
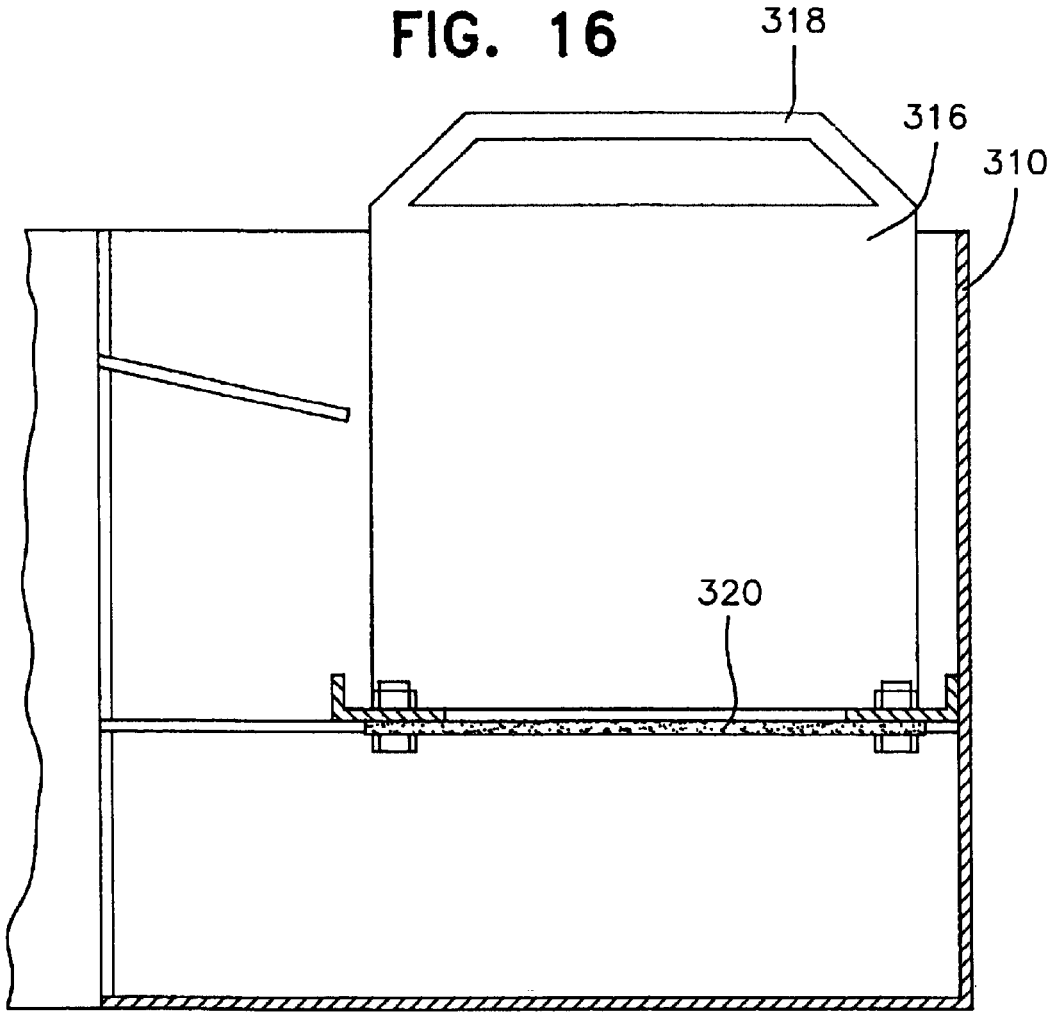
FIG. 16 is a vertical sectional, on an enlarged scale, taken along section line 16—16 on FIG. 15 illustrating structural details of the external fines screen tray.
Figure 17:
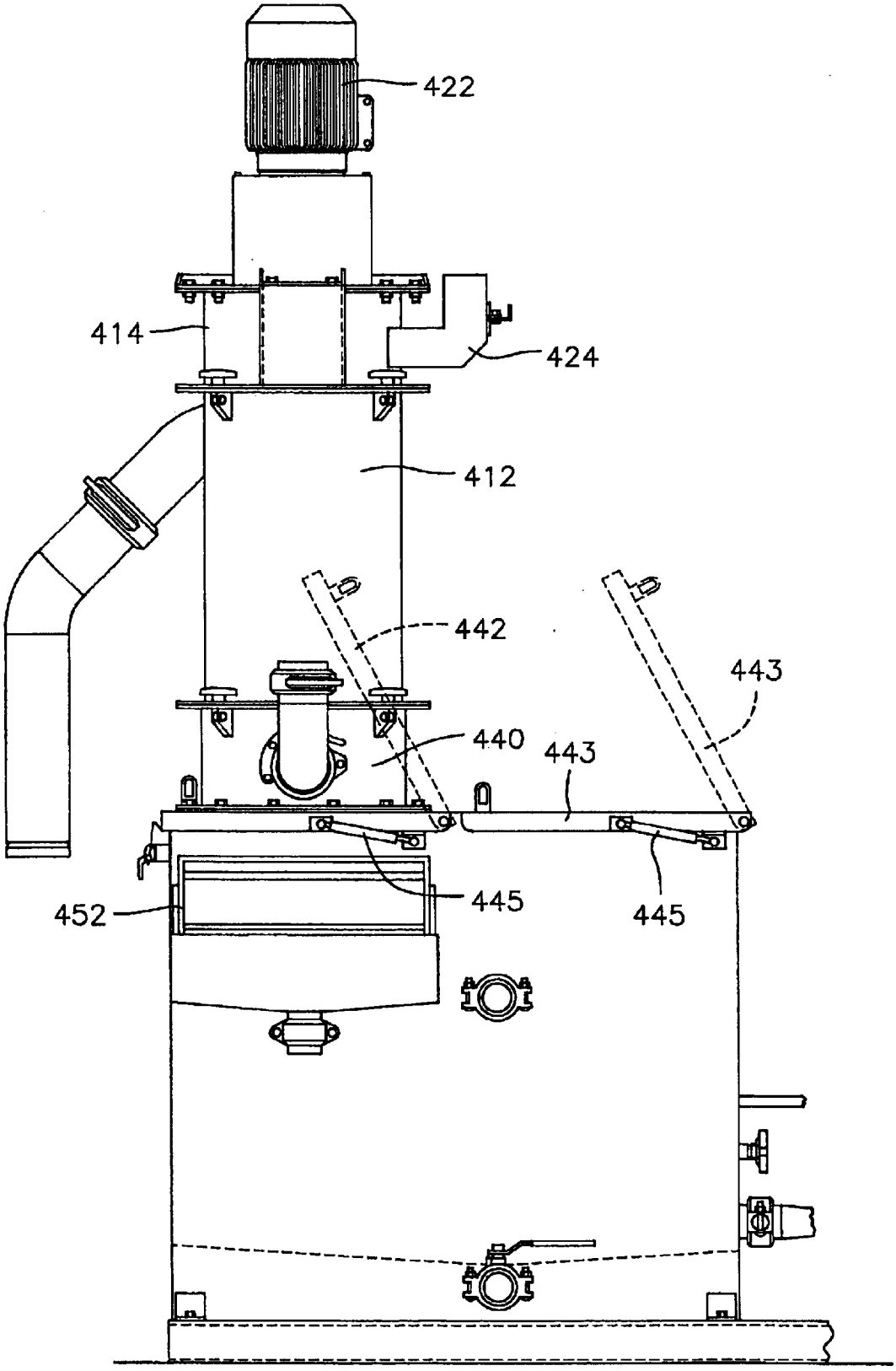
FIG. 17 is a side elevational view of another embodiment of the centrifugal pellet dryer of the present invention for use in a commercial application illustrating the association of the components with the water drain tank and the air circulation outlet associated with the upper end of the cylindrical housing.
Figure 18:
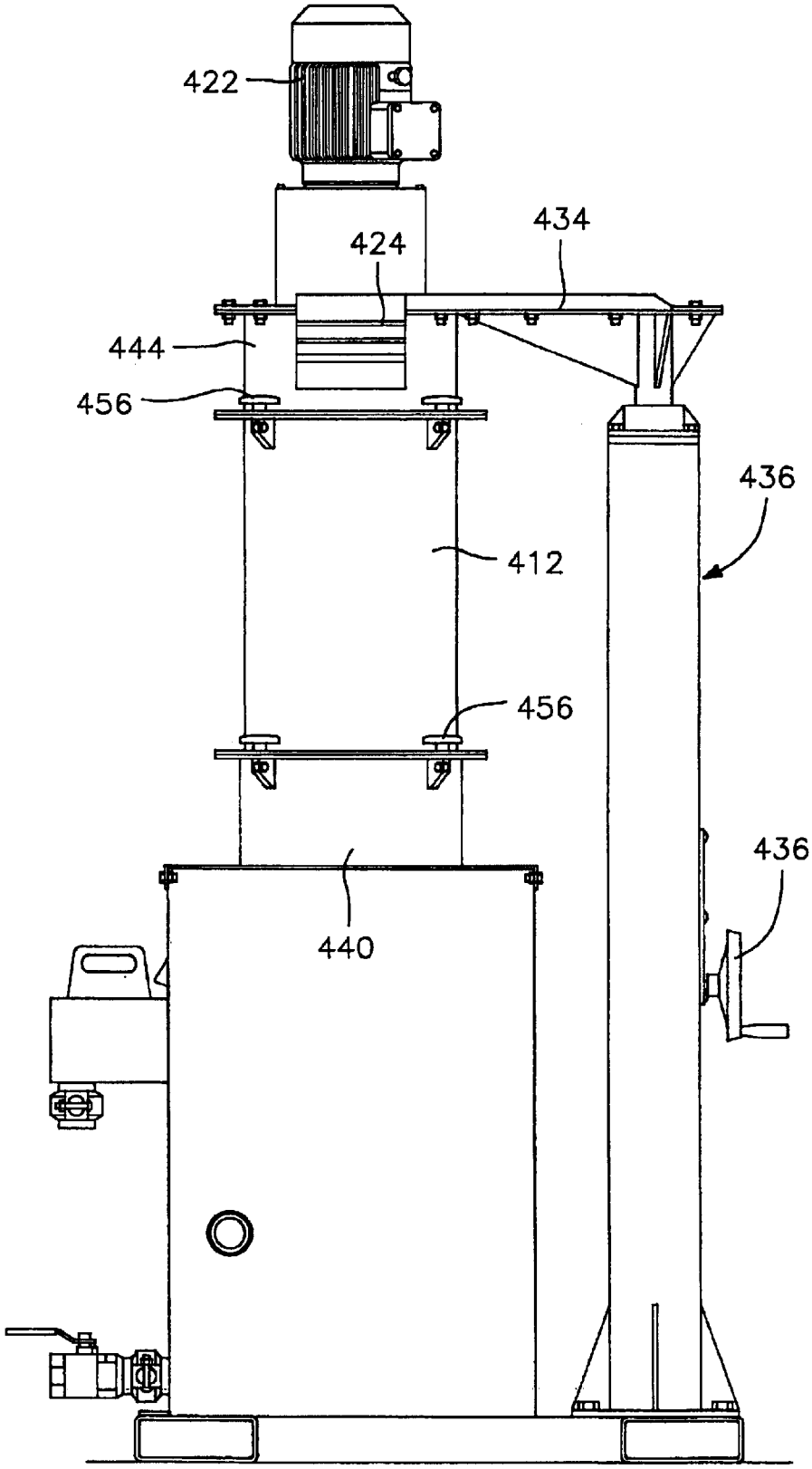
FIG. 18 is an end elevational view of the centrifugal pellet dryer of FIG. 17 illustrating the hand operated mechanical lift device for the upper components of the dryer to enable them to be separated from a base section and lifted and swung about a vertical axis for access to the interior components of the dryer.
Figure 19:
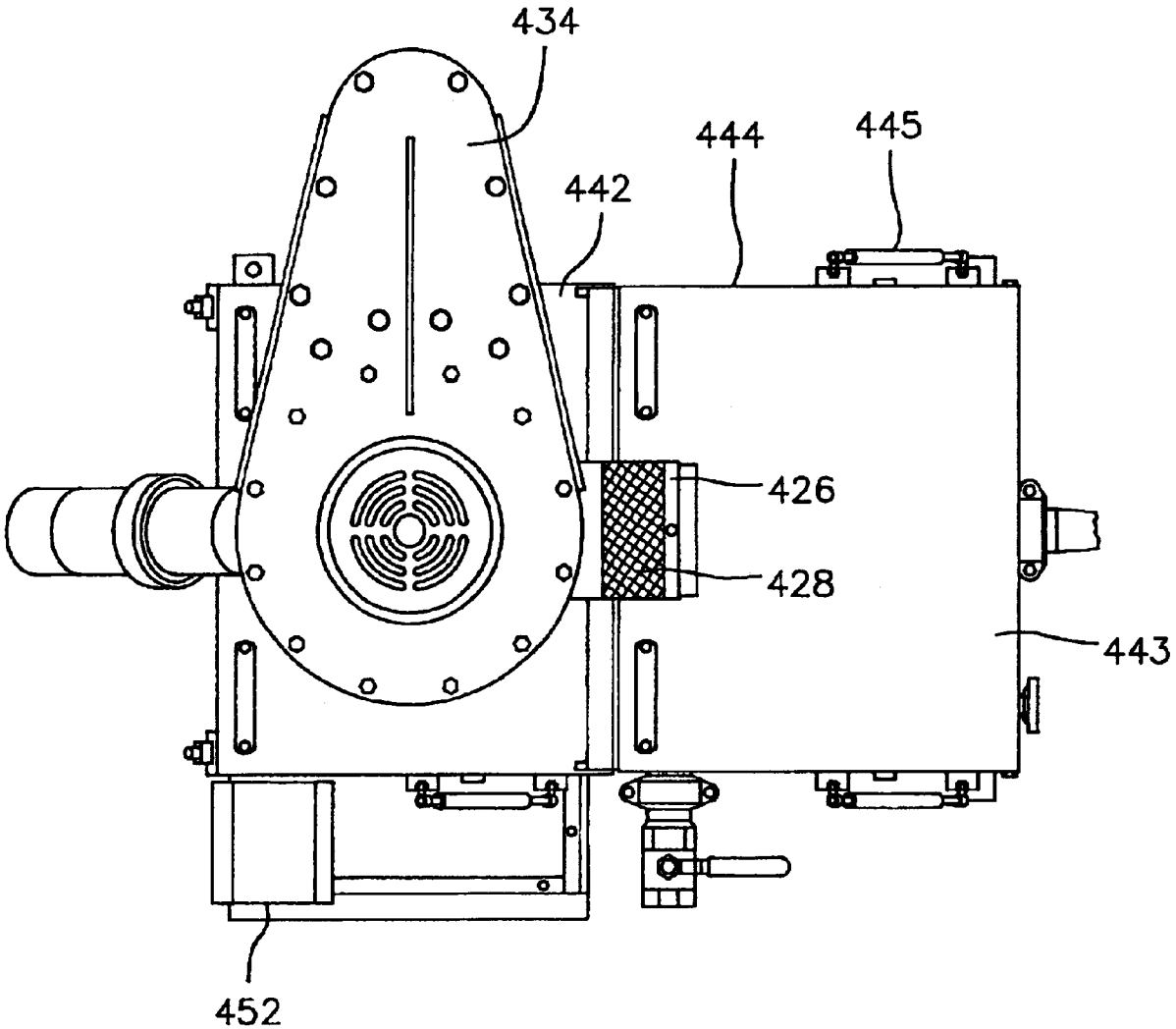
FIG. 19 is a top plan view of the pellet dryer illustrated in FIGS. 17 and 18.

FIGS. 11 and 15 also illustrates lift devices 324 connected between the tank 274 and the pivotal portion 269 of tank top 270 which has the base section 224 mounted thereon. The lift device 324 facilitate the pivotal movement of the tank top portion 269 to provide access to the screen 272 and also tilt the base section for cleaning and replacement of components as necessary. The lift devices 324 are also in the form of a gas lift cylinder at each side of the pivotal portion 269 and is connected to the pivotal portion 269 by brackets 326 and to the tank by brackets 328. The tank top 269 and 271 may pivot at the outer edges as shown or at either edge.

The provision of the screen device and baffle assures the separation of fines from water with the water draining into the collecting tank and the fines being deposited in the trap mounted on the side of the tank.

Figure 20:
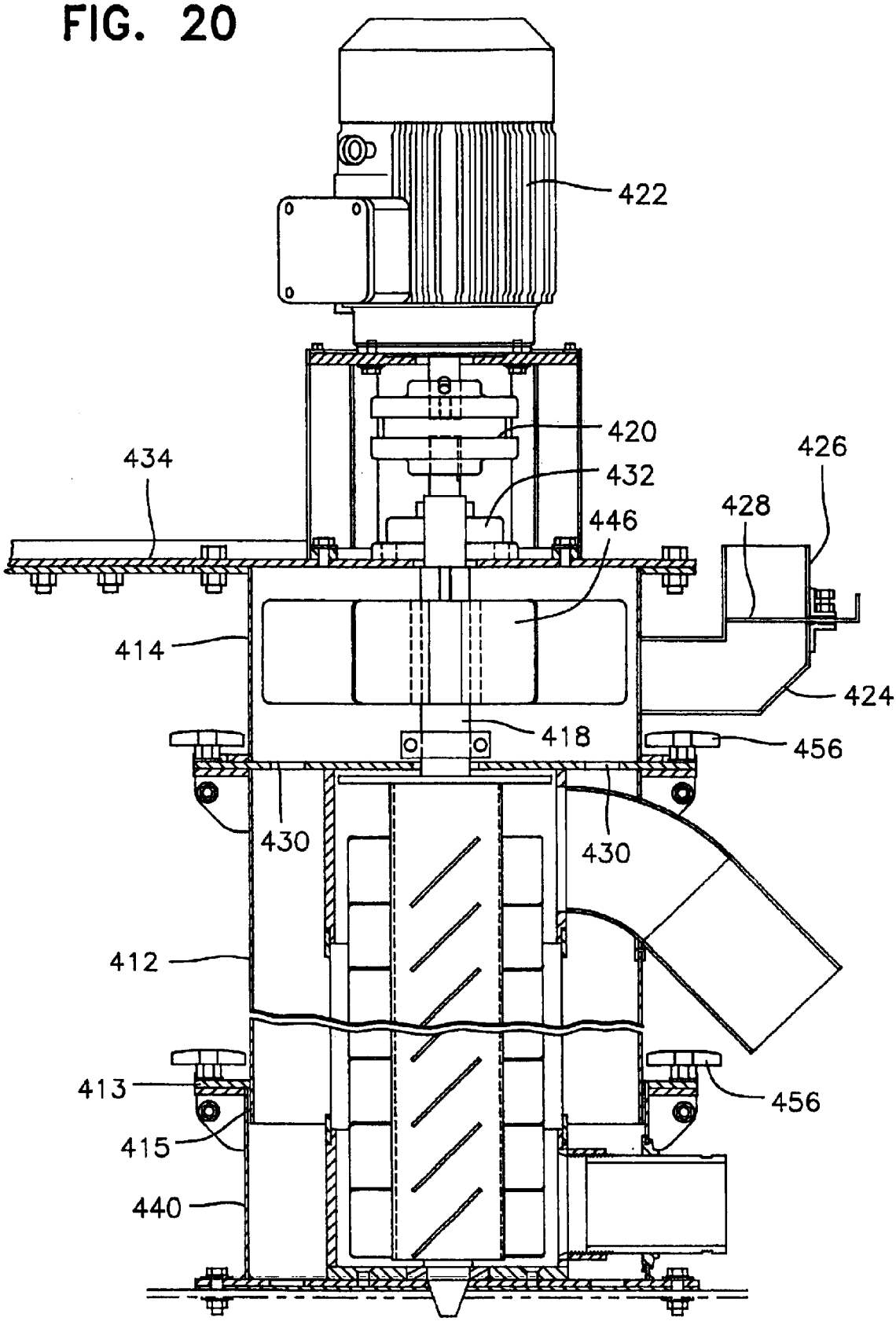
FIG. 20 is a vertical sectional view, on an enlarged scale, of the dryer of FIGS. 17 and 18 illustrating the association of the air fan with the upper section of the housing and the air outlet associated with the housing and a gasket free seal between the lower end of the upper section of the housing and the base section thereof.
Figure 21:
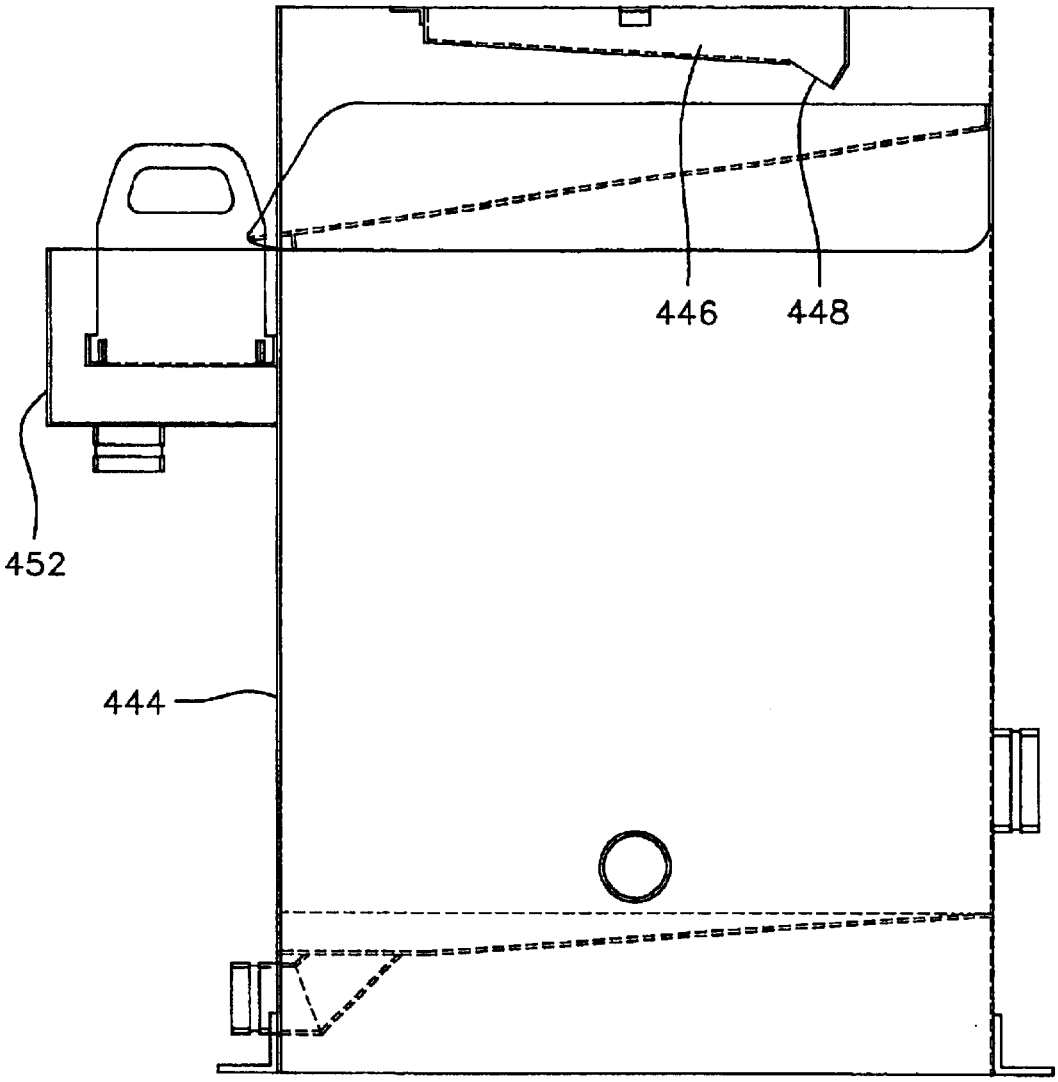
FIG. 21 is a schematic end view of the water drain tank of the FIGS. 17 and 18 embodiment illustrating a baffle on the underside of the pivotal top portion of the tank for discharging water and fines onto the upper end of the inclined screen.
Figure 22:
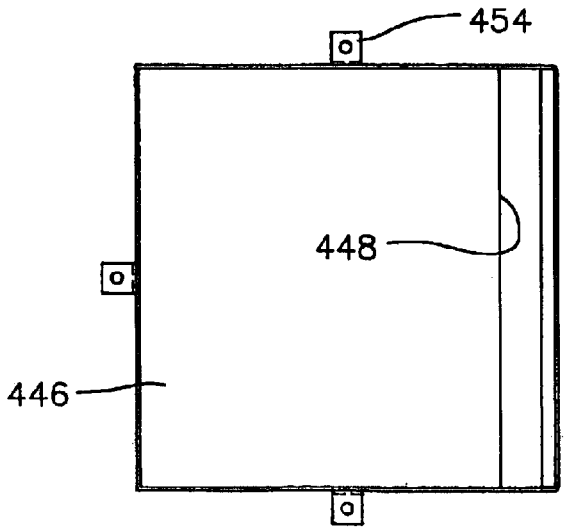
FIG. 22 is a detailed plan view of the baffle illustrated in FIG. 21 mounted on the underside of the pivotal tank portion.

FIGS. 17–22 illustrate another commercial embodiment of the invention in which the tank, housing, screen, rotor and motor are all similar to the structures illustrated in FIGS. 1–16. However, in this embodiment of the invention, a fan, preferably a centrifugal fan 416, and cylindrical fan housing 414 are mounted above the cylindrical housing 412 of the dryer and below the top or support plate 434 which supports the motor 422. The fan 416 is connected to the motor drive shaft 418 below the shaft coupling 420 and is driven by the motor 422. The fan housing 414 includes a laterally extending discharge or outlet 424 having an upwardly extending terminal end 426 provided with a screen 428 therein. The fan housing 414 also includes a bottom plate 431 and the interior of the fan housing 414 communicates with the lower sections of the dryer housing 412 through openings 430 in plate 431. With fan 416 operating, the openings 430 permit air to circulate upwardly through the housing 412 to assist in removing moisture from the pellets being dried. The structure of the fan and its relationship to the other components of the pellet dryer is best illustrated in FIG. 20 with the lower portion of the housing 412 being the same as described in the previous embodiments of the invention and the operation of the rotor, blades, screen, slurry inlet and dried pellet outlet also being the same.

The lower end of the rotor is also journalled in a bushing rather than a supporting bearing, as in the previous embodiments, and the entire weight of the rotor is thus supported by support bearing 432 at the upper end of the fan housing 414 which is closed by the support plate 434. The dryer housing 412 and the components above the housing 412 are vertically lifted by a lift device 436 connected to the support plate 434 which projects to one side of the housing. The lift device 436 is a manually operated screw lift device having a hand crank 438 attached thereto to rotate a threaded component in the form of a nut which engages an elongated lead screw to raise and lower the support plate 434. This structure is similar to a mechanical lift jack with the vertically moveable member also being capable of permitting the support plate and the elevated housing and related components to swivel about a vertical axis to an out of the way position for cleaning and repair.

As illustrated in FIG. 20, the lower end of the upper section of the housing 412 extends below the flanges 413 to form a gasket free seal at 415 between a base section 440 and the upper section of housing 412. This gasket free seal 415 can be used in each embodiment of the present invention.

In this embodiment of the invention, the housing base section 440 is mounted on a pivotal section 442 of the water drain tank top. The water drain tank top includes a second pivotal section 443, and the pivotal sections 442 and 443 each is provided with a gas lift cylinder 445 so that the entire top of the water drain tank can be easily opened for access to the tank. The pivotal section or sections of the tank top may be pivotally connected to any edge of the tank with gas spring lift devices 445 provided in each embodiment of the invention to assist in pivoting the base section of the housing to an inclined position. Also, swing bolts 456 such as shown in FIG. 7 at 134 are preferably used in this form of the invention. The bottom surface of the tank top pivotal portion 442 below base section 440 is provided with a slanted baffle plate 446 (see FIG. 21) which has a lower discharge edge 448 in alignment with an upper end portion of slanted or inclined screen 450 so that the drain water and any fines entrained therein will be discharged onto the screen 450 adjacent its upper end. The inclined screen 450 extends through an opening in the wall of the tank 444 into a screen trap 452. The baffle 446 is in the form of a tray having mounting lugs 454 at its upper edges to secure the baffle 446 to the under surface of the pivotal tank top 442.

If desired, the dryer of this invention may be provided with a pump to recirculate water from the drain tank back to an associated underwater pelletizer, and a screen or other device may be incorporated into the slurry inlet to remove pellet agglomerates. In commercial embodiments of the invention, the dryer housing can have an outside diameter of approximately 40 inches suitable for commercial applications. The screen can have a diameter of approximately 36 inches with the outer corners of the blades being spaced inwardly approximately 1 to 2 inches from the screen for optimum removal of water from the pellets. The blades are preferably rectangular with the straight peripheral edges providing agitation of the pellets as they are lifted with the space between the blades and screen permitting some of the pellets to drop past upper blades and picked up by lower blades for more effective separation of water from the pellets. Also, the blade arrangement and configuration and their relationship to the screen reduces wear on the screen as compared to dryers which utilize a substantially continuous lifting and auguring effect that increases frictional engagement between the pellets and screen.

The components of the dryer of the present invention are readily disconnected and the weight thereof supported by the lift device thereby facilitating the handling of the housing, screen, rotor and motor without the necessity of these components being physically lifted by an operator of the pellet dryer. The lifting device not only lifts the upper housing section, screen and rotor away from the housing base section and water drain tank, but also provides for swiveling of these components away from the remaining lower components. By this upward movement and rotation of the top supported components away from the stationary base components, all of the components of the centrifugal pellet dryer including the upper bearing assembly, the rotor, the bottom of the housing including the alignment bushing and holes for passage of water into the water drain tank, can be readily cleaned, serviced and/or replaced as necessary. Similarly, the lifting and swiveling mechanism allows the top of the water tank to be readily opened for access to the interior thereof despite the mounting of the housing directly on the top of the tank. Hence, the dryer of the present invention can be adopted for a large range of pellet dryer applications including small laboratory usages up to very large commercial dryer applications.

The foregoing is considered as illustrative only of the principles of the invention. Further, numerous modifications and changes will readily occur to those skilled in the art. For example, while screens are preferably one-piece screen elements, these screens can be constructed of two or more separable sections connected together as a one-piece structure. As such, it is not desired to limit the invention to the exact construction and operation shown and described, and, accordingly, all suitable modifications and equivalents may be resorted to, falling within the scope of the invention.

What is claimed as new is as follows:

1. A dryer for removing surface moisture from pelletized product in the form of a slurry of pellets and water comprising a housing, said housing including detachably connected upper and lower sections, a slurry inlet at a lower end portion of said lower housing section, a dried pellet outlet at an upper end portion of said housing, a cylindrical screen mounted within said housing, an elevating rotor positioned within said screen, a motor drivingly connected to said rotor, said slurry inlet communicating with the interior of said screen, said dried pellet outlet communicating with the interior of said screen, and said motor being mounted on an upper end of said upper housing section and driving said rotor through a bearing structure in said upper housing section, a lower end of said rotor guidingly received in an alignment assembly in a lower portion of said lower housing section thereby eliminating a sealed bearing structure for the lower end of said rotor.

2. The dryer as defined in claim 1, wherein said upper and lower housing sections include peripheral flanges and bolts detachably connecting said flanges and detachably connecting said housing sections.

3. The dryer as defined in claim 2, wherein a lower end of said rotor includes a tapered lower end having a cylindrical portion journaled in said alignment assembly, said alignment assembly including a replaceable sleeve.

4. The dryer as defined in claim 1, wherein a lower end of said rotor includes an axial extension rotatably engaged with said alignment assembly, said alignment assembly being fixed in concentric relation to the screen and said lower housing section and being lubricated and cooled by water removed from said slurry.

5. The dryer as defined in claim 1, wherein said housing includes upper and lower cylindrical members in alignment with and supporting engagement with upper and lower ends of said screen, the ends of the screen and cylindrical members including an interfitted relation whereby moisture passing through the screen will pass downwardly for passage into a tank, said lower cylindrical member including a plurality of upwardly diverging rods guiding a lower end of the screen into interfitted relation with an upper end of said lower cylindrical member.

6. The dryer as defined in claim 1, wherein said housing is supported on the top of a water drain tank, said housing being in communication with said drain tank for discharging water directly from said housing into said tank.

7. The dryer as defined in claim 1, wherein said upper and lower housing sections include upper and lower cylindrical members in alignment with and supporting engagement with upper and lower ends of said screen, the ends of the screen and cylindrical members including an interfitted relation whereby moisture passing through the screen will pass downwardly exteriorly of the lower cylindrical member for passage into a tank.

8. The dryer as defined in claim 7, wherein said screen includes a pair of hooks on an upper end, said upper cylindrical member including a pair of projecting pins detachably supporting said hooks and screen.

9. The structure as defined in claim 7, wherein said screen includes a pair of upstanding hooks at the upper end thereof, said upper cylindrical member including a pair of projecting pins for detachably supporting engagement with said hooks.

10. The structure as defined in claim 9, wherein said hooks open peripherally of said screen to enable the screen to be assembled onto and separated from said upper cylindrical member by partial rotation of the screen.

11. A dryer for removing surface moisture from pelletized product comprising a housing, a water and pellet slurry inlet at a lower end portion of said housing, a dried pellet outlet at an upper end portion of said housing, a screen mounted within said housing, an elevating rotor positioned within said screen, motor drivingly connected to said rotor, said slurry inlet communicating with the interior of said screen, said pellet outlet communicating with the interior of said screen, said housing including a separable base section having a water discharge, said base section supporting an upper section of said housing and a lift device for elevating said upper section of said housing upwardly in a generally vertical direction above said base section when the upper section is separated from said base section.

12. The dryer as defined in claim 11, wherein a lower end of said rotor is supported by an alignment assembly fixed in relation to the screen and base section of the housing.

13. The dryer as defined in claim 12, wherein said tank includes a movable top portion, said base section of said housing being mounted on said movable top portion of the tank.

14. The dryer as defined in claim 13, wherein said movable portion of the top portion of the tank is pivotally supported to enable said base section to be pivoted toward a position to enable cleaning when the upper section of said housing is elevated by said lift device.

15. The dryer as defined in claim 11, wherein said housing includes upper and lower cylindrical members in alignment with and supporting engagement with upper and lower ends of said screen, the ends of the screen and cylindrical members including an interfitted relation whereby moisture passing through the screen will pass downwardly through said base section into a tank.

16. The dryer as defined in claim 11, wherein said lift device supports said motor, rotor, screen and upper section of said housing when said upper section of said housing is disconnected from a lower section thereof and elevated upwardly by said lift device.

17. The dryer as defined in claim 11, wherein said base section is communicated with a tank for receiving moisture passing through the screen, through a base section and into a tank.

18. The dryer as defined in claim 17, wherein said lift device supports said motor, rotor, screen and upper section of said housing when said upper section of said housing is disconnected from a lower section thereof and elevated by said lift device.

19. The dryer as defined in claim 18, wherein said lift device includes an elevating element swivelled about a vertical axis when the elevating element lifts the dryer components upwardly thereby enabling the elevated components to swing about a vertical axis to a position spaced laterally of a lower section of the housing to enable removal of the screen and to facilitate cleaning of the dryer.

20. The dryer as defined in claim 19, wherein said lift device is a gas spring.

21. The dryer as defined in claim 17, wherein said housing includes upper and lower cylindrical members in alignment with and supporting engagement with upper and lower ends of said screen, the ends of the screen and cylindrical members including an interfitted relation whereby moisture passing through the screen will pass downwardly through said base section into said tank.

22. The dryer as defined in claim 21, wherein an upper end of said screen and said upper cylindrical member have coacting support structure to detachably support said screen from said upper cylindrical member.

23. The dryer as defined in claim 22, wherein said screen support structure includes a pair of laterally opening hooks attached to and extending above an upper end of said screen and a pair of projecting pins on said upper cylindrical member.

24. The dryer as defined in claim 23, wherein said screen in said tank is mounted in a removable frame inserted into said tank.

25. The dryer as defined in claim 24, wherein said screen is inclined and includes a lower edge portion in registry with an opening in a wall of said tank for discharging fines through said opening.

26. The dryer as defined in claim 25, wherein a fines receiving trap is positioned externally of said tank in association with said opening to receive fines discharged through said opening.

27. The dryer as defined in claim 23, wherein said screen in said tank is inclined and includes a lower edge portion in registry with an opening in a wall of said tank for discharging fines through said opening.

28. A dryer for removing surface moisture from pelletized product in the form of a slurry of pellets and water comprising a housing, a slurry inlet at a lower end portion of said housing, a dried pellet outlet at an upper end portion of said housing, a cylindrical screen mounted within said housing, said screen including a peripheral perforated wall in spaced relation to the housing, a rotor positioned within said screen, axially inclined radial lifting blades on said rotor moving in a path concentric with and adjacent said screen, and a motor drivingly connected to said rotor, said slurry inlet communicating with the interior of said screen, said dried pellet outlet communicating with the interior of said screen, said housing including separable upper and lower sections, said motor being mounted on said upper section of said housing and driving said rotor through a bearing structure in said upper section with a lower end of said rotor guidingly and rotatably received in an alignment assembly in said lower housing section thereby eliminating a sealed bearing structure for the lower end of said rotor, said housing including upper and lower cylindrical members in alignment with and in supporting engagement with upper and lower ends of said screen, the ends of the screen and cylindrical members including an interfitted relation whereby moisture passing through the screen will pass downwardly exteriorly of the lower cylindrical member for passage into a tank.

29. A dryer for removing surface moisture from pelletized product in the form of a slurry of pellets and water comprising a housing, a slurry inlet at a lower end portion of said housing, a dried pellet outlet at an upper end portion of said housing, a cylindrical screen mounted within said housing, said screen including a peripheral perforated wall in spaced relation to the housing, a rotor positioned within said screen, axially inclined radial lifting blades on said rotor moving in a path concentric with and adjacent said screen, and a motor drivingly connected to said rotor, said slurry inlet communicating with the interior of said screen, said dried pellet outlet communicating with the interior of said screen, said housing including separable upper and lower sections, said motor being mounted on said upper section of said housing and driving said rotor through a bearing structure in said upper section with a lower end of said rotor guidingly and rotatably received in an alignment assembly in said lower housing section, said lower end of said rotor includes a cylindrical body portion journaled in said alignment assembly, and said alignment assembly includes a replaceable sleeve.

30. The dryer as defined in claim 29, wherein said housing includes upper and lower cylindrical members in alignment with and supporting engagement with upper and lower ends of said screen, the ends of the screen and cylindrical members including an interfitted recessed relation whereby moisture passing through the screen will pass downwardly for passage into a tank, said lower cylindrical member including a plurality of upwardly diverging rods guiding said lower end of the screen into interfitted relation with an upper end of said lower cylindrical member.

31. A dryer for removing surface moisture from pelletized plastic product comprising a housing, a water and pellet slurry inlet at a lower end portion of said housing, a dried pellet outlet at an upper end portion of said housing, a screen mounted within said housing, said screen including a peripheral perforated wall in spaced relation to the housing, a rotor positioned within said screen, a motor drivingly connected to said rotor, said slurry inlet communicating with the interior of said screen, said pellet outlet communicating with the interior of said screen, said housing including a separable base section having a water discharge, said base section supporting an upper section of said housing, and a lift device connected with said housing above said base section for elevating said housing upper section upwardly above said base section when the upper section is separated from said base section.

32. The dryer as defined in claim 31, wherein said base section is communicated with a tank for receiving moisture passing through the screen, through the base section and into the tank.

33. The dryer as defined in claim 31, wherein a lower end of said rotor is guided by an alignment assembly fixed in relation to the screen and base section of the housing.

34. The dryer as defined in claim 31, wherein said housing includes upper and lower cylindrical members in alignment with and in supporting engagement with upper and lower ends of said screen, the ends of the screen and cylindrical members including an interfitted relation whereby moisture passing through the screen will pass downwardly through said base section into a tank.

35. The dryer as defined in claim 34, wherein an upper end of said screen and said upper cylindrical member have coacting support structure to detachably support said screen from said upper cylindrical member.

36. The dryer as defined in claim 31, wherein said housing sections are interconnected by flanges on said housing sections, and bolt and nut assemblies secure said flanges together.

37. The dryer as defined in claim 36, wherein each of said bolts includes pivotal support structure, each of said flanges includes radial notches receiving said bolts and enabling the bolts to swing into and out of said notches when said nuts are loosened.

38. A centrifugal pellet dryer for laboratory use comprising a housing, screen and elevating rotor oriented in concentric relation with the rotor being driven from an upper end and the screen including a pellet slurry inlet at a lower portion and a dried pellet outlet at an upper portion, said housing supported from the top wall of a tank and in communication with the tank for discharge of water from said screen and housing directly into the tank, said tank including a screen bottomed drawer receiving water from said housing to separate solid particles entrained in said water, said drawer being solidly mounted in a top area of said tank to enable removal of solid particles from the drawer.

39. A dryer for removing surface moisture from pelletized product in the form of a slurry of pellets and water comprising a housing including separable upper and lower sections, a cylindrical screen mounted within said housing, an elevating rotor positioned within said screen, a motor drivingly connected to said rotor, a slurry inlet communicating with a lower interior portion of said screen, a dried pellet outlet communicating with an upper interior portion of said screen, said motor being mounted on said upper section of said housing and driving said rotor through a bearing structure in said upper section of the housing with a lower end of said rotor guidingly received in an alignment assembly in said lower section of the housing, said rotor including an axial extension rotatably engaged with said alignment assembly, said alignment assembly being fixed in concentric relation to the screen and said lower housing section and being lubricated and cooled by water from said slurry.

40. The dryer as defined in claim 39, wherein said water and pellet slurry inlet communicates into said screen through said housing lower section and said dried pellet outlet communicates into said screen through said housing upper section.

41. The dryer as defined in claim 39, wherein said tank includes a screen member mounted in a top area of said tank for receiving water from said housing to separate solid particles entrained in said water.

42. The dryer as defined in claim 39, wherein an upper end of said screen and said upper cylindrical member have coacting support structure to detachably support said screen from said upper cylindrical member.

43. The dryer as defined in claim 39, wherein a lower end of said rotor includes an extension having a cylindrical portion journaled in said alignment assembly, and said alignment assembly includes a replaceable sleeve which engages said rotor extension cylindrical portion.

44. A dryer for removing surface moisture from pelletized product comprising a housing having an upper section and abase section, a generally cylindrical screen mounted within said housing, an elevating rotor positioned within said screen, a motor drivingly connected to said rotor, a water and pellet slurry inlet communicating with the interior of said screen, a dried pellet outlet communicating with the interior of said screen, said base section of the housing being separable from the upper section and having a water discharge, and a lift device to lift said upper section of the housing, rotor and screen generally vertically and upwardly away from and out of said base section, said lift device also being rotatable to rotate said upper section of the housing, rotor and screen away from vertical alignment with said base section.

45. The dryer as defined in claim 44, wherein said lift device is also rotatable about a vertical axis to rotate said housing upper section, said rotor and said screen away from vertical alignment with said base section.

46. The dryer as defined in claim 44, wherein said water and pellet slurry inlet communicates with the interior of said screen adjacent a lower end of said screen through said housing base section and said dried pellet outlet communicates with the interior of said screen adjacent an upper end of said screen through said housing upper section.

47. The dryer as defined in claim 44, wherein said housing includes a top plate at the top end thereof, said upper section and said screen each detachably supported by said top plate and, upon removal of said upper section and said screen, said rotor becomes fully exposed.

48. In combination with a pellet dryer which discharges water with entrained pellet fines into a water tank, a rigid fines removal screen supported in said tank in a position to receive discharged water with entrained fines from said dryer, said screen permitting flow of water therethrough into the tank and retaining pellet fines on an upper surface of said screen thereby enabling removal of said pellet fines from said screen and tank, said screen being inclined to discharge pellet fines from a lower edge thereof into a fines collection tray underlying said lower edge of the screen.

49. The combination of claim 48, wherein said fines collection tray includes a bottom screen to further separate water from the fines and discharge of water into the tank.

50. The combination of claim 49, wherein said fines collection tray is removably supported from said tank to enable removal of separated fines from the tank.

51. The water tank of claim 49, wherein said fines removal screen includes upwardly extending side edge walls to retain said pellet fines on said upper surface of said fines removal screen.

52. A water tank for receiving process water with entrained pellet fines from a pellet dryer which comprises a water collecting tank and a relatively flat fines removal screen mounted in said water tank, said screen positioned in said tank for gravity flow of said process water therethrough into the tank while retaining pellet fines on an upper surface thereof to enable removal of said pellet fines from said tank, said screen being inclined to discharge pellet fines from a lower edge thereof into a fines collection tray underlying said lower edge of the screen.

53. The combination of claim 52, wherein said fines collection tray includes a bottom screen to further separate water from the fines and discharge of water into the tank.

54. The combination of claim 53, wherein said fines collection tray is removably supported from said tank to enable removal of separated fines from the tank.

* * * * *